US005288599A

United States Patent [19]

Takahashi et al.

[11] Patent Number: 5,288,599

[45] Date of Patent: Feb. 22, 1994

[54] SILVER HALIDE COLOR PHOTOGRAPHIC MATERIAL AND COLOR PHOTOGRAPHIC IMAGE-FORMING PROCESS

[75] Inventors: Osamu Takahashi; Kazunori Hasebe; Kentaro Osazaki, all of Kanagawa, Japan

[73] Assignee: Fuji Photo Film Co., Ltd., Kanagawa, Japan

[21] Appl. No.: 965,029

[22] Filed: Oct. 23, 1992

[30] Foreign Application Priority Data

Oct. 23, 1991 [JP] Japan ..... 3-302666
Nov. 22, 1991 [JP] Japan ..... 3-332888

[51] Int. Cl.[5] ..... G03C 1/46

[52] U.S. Cl. ..... 430/507; 430/512; 430/551; 430/553; 430/552

[58] Field of Search ..... 430/507, 551, 553, 512, 430/552

[56] References Cited

U.S. PATENT DOCUMENTS 4,668,611 5/1987 Nakamura ..... 430/507
5,173,395 12/1992 Asami ..... 430/507

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographic material and an image forming process using the same are disclosed. Said silver halide color photographic material comprises a reflecting support and provided thereon three light-sensitive silver halide emulsion layers each having a different light sensitivity to a different wavelength region, including a light sensitive silver halide emulsion layer containing a yellow dye-forming coupler, a light sensitive silver halide emulsion layer containing a magenta dye-forming coupler, and a light sensitive silver halide emulsion layer containing a cyan dye-forming coupler. The silver halide color photographic material satisfies the following conditions.

(1) said cyan coupler is a compound represented by the following formula (C), and of the three silver halide emulsion layers, the silver halide emulsion layer containing the cyan coupler is disposed at the farthest position from the support, pl (2) a hydrophilic light-insensitive layer containing a compound represented by the following formula (I) and which does not substantially contain an ultraviolet absorbent is formed under said cyan coupler-containing silver halide emulsion layer adjacent thereto, (3) a hydrophilic light-insensitive layer which contains an ultraviolet absorbent and which does not substantially contain a compound represented by the following formula (I) is formed over said cyan coupler-containing silver halide emulsion layer, and (4) the average silver chloride content of the silver halide contained in each silver halide emulsion layer is at least 90 mol%;

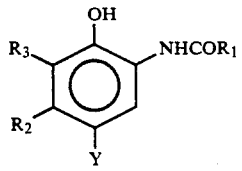

(C)

wherein $R_1$, $R_2$, $R_3$ and Y are as defined in claim 1.

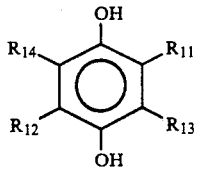

(I)

wherein $R_{11}$, $R_{12}$, $R_{13}$, $R_{14}$ are as defined in claim 1.

7 Claims, No Drawings

SILVER HALIDE COLOR PHOTOGRAPHIC MATERIAL AND COLOR PHOTOGRAPHIC IMAGE-FORMING PROCESS

FIELD OF THE INVENTION

The present invention relates to a silver halide color photographic material and a color image-forming process, and in particular to a silver halide color photographic material which has excellent rapid processing aptitude and excellent image storage stability after processing and to a color image-forming process using it.

BACKGROUND OF THE INVENTION

Recently, for meeting the requirement for rapid processing, a new system wherein a silver halide color photographic material using silver halide emulsions having a lower silver bromide content and a higher silver chloride content than conventional silver halide emulsions is processed in combination with a developer without using a sulfite and benzyl alcohol contained in a color developer for ordinary color photographic papers has been developed and is now being introduced into the market.

When such rapid processing was employed for processing color photographic papers, it sometimes happened that fading of a specific dye image became severe, in particular, under light irradiation, to thereby unbalance fading of three colors and hence to change the color tone, and also background portions which were non-imaged portions became colored in the case of storing the color photographs in the dark.

It is, as a matter of course, necessary in view of the purpose of storing color photographs to provide color photographs in which the extent of fading (light fading and dark fading) is less with respect to both fading under light irradiation and storage in the dark, and in which coloring of the background portions is maintained at a low degree. Accordingly, the foregoing change caused by employing rapid processing is a major problem.

Various attempts for improving the storage stability of color images have been made but in light fading of, in particular, cyan images, the improvement which so far has been obtained by conventionally proposed methods only is not sufficient. Since in a cyan image, the fading speeds between the case of being irradiated by intense light such as direct sunlight and the case of being irradiated by weak light such as room light for a long period of time differ from those of other dye images, a preferred result is not obtained if only an attempt is made to make cyan images which are resistant to fade, and hence a new means of improving both the fadings by intense light and weak light with a good balance has been desired.

As a means of improving this point, a method of using a compatible dispersion of a cyan coupler and a polymer latex is disclosed in PCT W088/00723 and JP-A-63-44658 (the term "JP-A" as used herein means an "unexamined published Japanese patent application"), but the foregoing method is insufficient since the density of cyan images in the case of being irradiated with intense light is greatly lowered. Also, JP-A-3-192347 discloses a method of adding a halogen-substituted hydroquinone to a cyan coloring layer to simultaneously meet the resistance to a fluctuation of photographic properties depending on the exhaustion of a processing solution and the resistance to light fading, but the method is yet insufficient and a further improvement has been desired.

As the result of various investigations by the inventors, it has been found that in a silver halide color photographic material having on a reflecting support three light-sensitive silver halide emulsion layers, each having a different light-sensitivity (i.e., a sensitivity to a different wavelength region), one containing a yellow dye-forming coupler, one containing a magenta dye-forming coupler, and one containing a cyan dye-forming coupler, a color photographic material capable of rapid processing and showing improved cyan fading can be obtained by using a specific cyan coupler, disposing the silver halide emulsion layer containing the cyan coupler at the position farthest from the support with respect to the three silver halide emulsions, forming a hydrophilic light-insensitive layer which contains a specific hydroquinone compound and which does not substantially contain an ultraviolet absorbent under (the support side) the cyan coupler-containing emulsion layer adjacent thereto, and using a silver halide having a silver chloride content of at least 90%.

However, as the result of further making the investigations, it has been clarified that by such a construction described above, the gradation of the high-density portions is softened and so-called loose images are liable to form. Thus, for obtaining steady and clear images, a means for preventing the occurrence of softening of high density portions is required.

SUMMARY OF THE INVENTION

An object of the present invention is, therefore, to obtain both the good rapid processing property and a good image storage stability of a high-silver chloride color photographic material which is excellent in the rapid processing aptitude, and to provide a silver halide color photographic material which is resistant to light fading of the cyan dye by strong light and weak light, which provides a good balance of the cyan dye with other dyes .in rapid processing, and wherein the coloring of background portions in dark-fading is less, and softening of the gradation of the high-density portions is less, and also an image-forming process using the foregoing color photographic material.

It has now been discovered that the foregoing object can be attained by the silver halide color photographic material and the image-forming process of the present invention as described hereinbelow.

To achieve the above and other objects, the present invention provides a silver halide color photographic material comprising a reflecting support and provided thereon a three light-sensitive silver halide emulsion layers, each having a light sensitivity to a different wavelength region, including a light-sensitive silver halide emulsion layer containing a yellow dye-forming coupler, a light-sensitive silver halide emulsion layer containing a magenta dye-forming coupler and a light-sensitive silver halide emulsion layer containing a cyan dye-forming coupler, wherein (1) the cyan coupler is a compound represented by the following formula (C) and of the three silver halide emulsion layers, the cyan coupler-containing silver halide emulsion is disposed at the farthest position from the support, (2) a hydrophilic light-insensitive layer which contains a compound represented by the following formula (I) and which does not substantially contain an ultraviolet absorbent is formed under (the support side) the cyan coupler-containing silver halide emulsion layer adjacent thereto, (3)

a hydrophilic light-insensitive layer which contains an ultraviolet absorbent and which does not substantially contain a compound represented by the foregoing formula (I), is formed over the cyan coupler-containing emulsion layer, and (4) the average silver chloride content of the silver halide contained in each silver halide emulsion layer is at least 90 mol%;

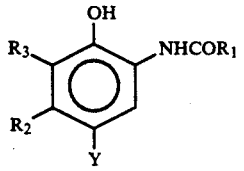

(C)

wherein $R_1$ represents a substituted or unsubstituted aliphatic group, a substituted or unsubstituted aromatic group, or a substituted or unsubstituted heterocyclic group; $R_2$ represents a substituted or unsubstituted aliphatic group having 2 or more carbon atoms; $R_3$ represents a hydrogen atom, a halogen atom, a substituted or unsubstituted aliphatic group, a substituted or unsubstituted aromatic group, or an acylamino group; and Y represents a hydrogen atom or a group capable of splitting off upon a coupling reaction with an oxidation product of a color developing agent;

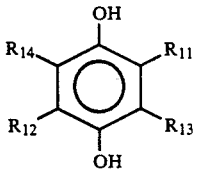

(I)

wherein $R_{11}$ represents a hydrogen atom or a substituent; $R_{12}$ may be the same as or different from $R_{11}$ and represents a hydrogen atom or a substituent; and $R_{13}$ and $R_{14}$, which may be the same or different, each represents a hydrogen atom or a substituent, and at least one of $R_{11}$ to R14 must be a substituent.

According to another aspect of the present invention, there is also provided a color photographic image-forming process, which comprises processing the foregoing color photographic material in a time of 4 minutes or less as the total time from color development to the end of a wash and/or stabilization step through a desilvering step.

In a conventional color photographic light-sensitive material, a layer containing an oil-soluble hydroquinone derivative is provided among the silver halide emulsion layers as a color mixing inhibiting layer for inhibiting the occurrence of color mixing during photographic processing of the color photographic material, and further for improving image storage stability, an ultraviolet absorbent is incorporated in color mixing preventing layers disposed over and under a silver halide emulsion layer containing a cyan dye-forming coupler. In particular, in a conventional high silver chloride color photographic paper, the light-insensitive layers each disposed over and under the silver halide emulsion layer containing a cyan dye-forming coupler simultaneously contains an oil-soluble hydroquinone derivative and an ultraviolet absorbent. On the other hand, in the present invention, contrary to conventional techniques, the foregoing object can be effectively achieved by a silver halide color photographic material wherein the layer over the silver halide emulsion layer containing the cyan dye forming coupler does not substantially contain an oil-soluble hydroquinone derivative and the layer under the emulsion layer containing the cyan dye-forming coupler does not substantially contain an ultraviolet absorbent and by rapid processing the silver halide color photographic material.

DETAILED DESCRIPTION OF THE INVENTION

The present invention is described in detail.

The terms "light-sensitive" and "light-insensitive" in the present invention are used with reference to the sensitivity to not only visible light but also to the electromagnetic waves of an infrared wavelength region.

Also, the term "a light-insensitive layer is formed under the cyan coupler-containing silver halide emulsion layer adjacent thereto" can include an embodiment in which the light-insensitive layer containing the compound shown by formula (I) is formed under the cyan coupler-containing silver halide emulsion layer through a thin light-insensitive hydrophilic layer (which may contain a coupler, etc.), but preferably means that the light-insensitive layer containing the compound shown by formula (I) is directly formed under the cyan coupler-containing silver halide emulsion layer without employing the foregoing thin light-insensitive hydrophilic layer.

The color photographic light-sensitive material of the present invention is comprised of at least one silver halide emulsion layer containing a yellow dye-forming coupler, at least one silver halide emulsion layer containing a magenta dye-forming coupler, and at least one silver halide emulsion layer containing a cyan dye-forming coupler, coated on a support.

In general, the silver halide emulsion layer containing the yellow dye-forming coupler, the silver halide emulsion layer containing a magenta dye-forming coupler, and the silver halide emulsion layer containing a cyan dye-forming coupler are formed on a support in this order from the support side.

By incorporating three light-sensitive silver halide emulsion layers each having a sensitivity to a different wavelength region and each having a so-called color coupler which forms a dye in a complementary color relation with the light to which the layer is sensitized, that is, a coupler forming a yellow color in a blue-sensitive layer, a coupler forming a magenta color in a green-sensitive layer, or a coupler forming a cyan color in a red-sensitive layer, color reproduction by a subtractive color process can be carried out. In this case, however, the colored hue of the light sensitive emulsion layer and the coupler may not have the construction having the aforesaid correspondence.

For the silver halide emulsions for use in the present invention, silver chloride, silver chlorobromide, silver chloroiodide, or silver chloroiodobromide each having a silver chloride content of at least 90 mol% is used. The silver iodide amount in the foregoing silver chlorobromoiodide and silver chloroiodide is generally from 0.01 to 3 mol%, preferably from 0.015 to 2 mol%, more preferably from 0.01 to 1 mol%, and particularly preferably from 0.03 to 0.6 mol%.

The halogen composition of the silver halide emulsion may be different or the same among the silver halide grains, but a silver halide emulsion having the same halogen composition among the silver halide grains is preferably used since in this case, the property of each grain can be easily homogenized. Also, in regard to the halogen composition distribution of the inside of the silver halide grains, a so-called homogeneous type structure silver halide grains wherein any portion of the grains has the same halogen composition, a so-called laminated layer type structure silver halide grains wherein the halogen composition differs between the core of the inside of the grains and the shell (single layer or plural layers) surrounding the core, or silver halide grains of a structure having non-layer portions formed of a different halogen composition in the inside or at the surface of the grains (in the case of having such different halogen composition portions at the surface of the grain, the structure is such that the portions of the different halogen composition can be joined to the edges, the corners, or the surface of the grain) can be properly used. For obtaining a high sensitivity, the use of each of the latter two types of the silver halide grains is better than the silver halide grains having the homogeneous type structure, and also is preferable with respect to pressure resistance. When the silver halide grains have the foregoing structure (each of the latter two types), the boundary portion between the portions each having a different halogen composition may be a clear boundary, an indistinct boundary forming mixed crystals by the difference in halide composition, or a positively formed continuous change of structure.

Also, for a silver halide photographic material suitable for rapid processing, a so-called high-silver chloride emulsion having a high silver chloride content is preferably used and in the present invention, a silver halide emulsion having a silver chloride content of at least 90% is used, a silver halide emulsion having a silver chloride content of at least 95% is more preferably used, and a silver halide content of at least 98 mol% is particularly preferably used.

Such a high-silver chloride emulsion preferably has a structure that the silver halide grains locally have a silver bromide-enriched phase in a layer form or a non-layer form as described above in the inside and/or at the surface of the silver halide grains. In the halogen composition of the foregoing localized phase, the silver bromide content is preferably at least 10 mol%, and more preferably over 20 mol%. Also, these localized phases can exist in the inside of the high-silver chloride grains, at the edges or the corners of the grain surfaces, or on the surface of the grain, but it is particularly preferable that the localized phases exist at the corner portions of the silver halide grains.

On the other hand, for restraining lowering of the sensitivity of the photographic light-sensitive material when applying pressure onto the light-sensitive material, silver halide grains having a homogeneous-type structure in which there is a narrow distribution of halogen composition in the grain are preferably used.

The average grain size (the diameter of a circle equivalent to the projected area of the grain is employed as the grain size and the average grain size is the number average of the grain sizes) of the silver halide grains contained in the silver halide emulsion being used in the present invention is preferably from 0.1 μm to 2 μm.

Also, as the grain size distribution, a so called monodisperse silver halide emulsion having a coefficient of variation (the standard deviation of the grain size distribution divided by the average grain size) of not higher than 20%, and desirably not higher than 15% is preferred. In this case, for the purpose of obtaining a broad latitude, it is preferable to use the foregoing monodisperse silver halide emulsion in a single layer as a blend with other silver halide emulsions, or to use the monodisperse silver halide emulsion in two different layers.

The form of the silver halide grains contained in the silver halide photographic emulsion for use in the present invention may be a regular crystal form such as cubic, tetradecahedral, octahedral, etc., an irregular crystal form such as spherical, tabular, etc., or a composite form of them. Also, a mixture of silver, halide grains having various crystal forms may be used. In the present invention, it is better that the amount of the silver halide grains having the foregoing regular crystal form is at least 50% based on the total amount of the silver halide grains, preferably at least 70%, and more preferably at least 90%.

Also, a silver halide emulsion wherein tabular silver halide grains having a mean aspect ratio (circle-converted diameter/thickness) of at least 5, and preferably at least 8, is more than 50% of the total silver halide grains, based on the projected area, can be preferably used.

The silver halide emulsions for use in the present invention can be prepared by using the methods described in P. Glafkides, *Chimie et Phisique Photographique* (published by Paul Montel Co., 1967), G. F. Duffin, *Photographic Emulsion Chemistry* (published by Focal Press Co., 1966), V. L. Zelikman et al, *Making and Coating Photographic Emulsion* (published by Focal Press, 1964), etc.

That is, an acid method, a neutralization method, an ammonia method, etc., can be used. Also, as a system of reacting a soluble silver salt and a soluble halide, a single jet method, a double jet method, or a combination of them can be used. A so-called reverse mixing method in which silver halide grains are formed in the presence of excess silver ions can be used. As one system of the double jet method, a so called double jet method wherein the pAg in the liquid phase which is used to form silver halide grains is kept constant can be also used, and according to this method, a silver halide emulsion containing silver halide grains in which the crystal form is regular and the grain sizes are almost uniform can be obtained.

The silver halide emulsion for use in the present invention can contain various multivalent metal ions as a dopant for the purposes of improving sensitivity, reciprocity law characteristics and dependency in temperature and humidity during exposure, latent image storage stability, etc., in the step of forming the silver halide grains or physical ripening. Examples of a compound which can be used for the purpose are salts of cadmium, zinc, copper, thallium, etc., and salts or complex salts of an element belonging to group VIII of the periodic table, such as iron, ruthenium, rhodium, palladium, osmium, iridium, platinum, etc. The addition amount of the aforesaid compound changes widely according to the purpose thereof, but is preferably from $10^{-9}$ to $10^{-2}$ mol per mol of silver halide.

It is preferred that the silver halide emulsion being used in the present invention is subjected to a chemical sensitization and a spectral sensitization.

That is, it is preferable that the silver halide emulsion of at least one layer of the silver halide emulsion layers in the present invention is chemically sensitized using a gold compound, and the valence of the gold in the gold compound may be monovalent or trivalent. Various gold compounds can be used. Typical examples thereof are tetrachloroauric(III) acid, tetracyanoauric (III), tetrakis(thiocyanato)auric(III) acid, the alkali metal salts of these auric acid, bis(thiosulfato)aurate(I), and the complex ion or complex salt of dimethylrhodanatogold chloride.

The amount of the gold compound which can be present can be selected in a wide range, but is generally from $1\times10^{-8}$ to $1\times10^{-2}$ mol, preferably from $1\times10^{-7}$ to $1\times10^{-3}$ mol, and more preferably from $1\times10^{-6}$ to $1\times10^{-4}$ mol, per mol of silver halide.

Also, the gold compound can be added during the preparation of a silver halide emulsion, but it is preferable to add the gold compound before finishing the chemical sensitization.

The chemical sensitization using a gold compound can be applied together with a sulfur sensitization by the addition of, for example, an unstable sulfur compound, a noble metal sensitization using a noble metal compound other than a gold compound, or a reduction sensitization. Also, to a silver halide emulsion which is not chemically sensitized using a gold compound, the foregoing other chemical sensitizations can be applied solely or as a combination thereof.

Spectral sensitization is applied for the purpose of imparting a different spectral sensitivity to a desired wavelength region in each silver halide emulsion in each emulsion layer of the color photographic light-sensitive material of the present invention. In the present invention, it is preferable to carry out spectral sensitization by adding a spectral sensitizing dye, i.e., a dye absorbing the light of a wavelength region corresponding to the desired spectral sensitization. Spectral sensitizing dyes being used in this case are described, e.g., in F. M. Harmer, *Heterocyclic Compounds-Cyanine Dyes and Related Compounds* (published by John Wiley & Sons Co., 1964, New York, London). Practical examples of the spectral sensitizing dyes and the spectral sensitizing methods being preferably used in the present invention are described in JP-A-62-215272, pages 22 to 38 (the term "JP-A" as used herein means an "unexamined published Japanese patent application").

To the silver halide emulsion being used in the present invention can be added various compounds or the precursors thereof for the purposes of preventing the occurrence of fog during the production, storage, and photographic processing of the color photographic light-sensitive material and stabilizing the photographic performance. Practical examples of the foregoing compounds which can be preferably used in this invention are described in JP-A-62-215272, pages 39 to 72.

In particular, the addition of at least one mercapto compound described in JP-A-2-123350, pages 416 to 423 to the silver halide emulsion being used in the present invention is greatly effective for preventing an increase of fog, in particular, an increase of fog caused by the use of a gold sensitizer. The mercapto compound may be added to the emulsion in the step of forming the silver halide grains, the desalting step, the step of chemical ripening, or directly before coating, but is preferably added in the step of forming silver halide grains, desalting, or chemical ripening, and is particularly preferably added before the addition of the gold sensitizer.

The silver halide emulsion for use in the present invention may be a so-called surface latent image type silver halide emulsion in which latent images are formed mainly on the surface of the silver halide grains, or a so-called internal latent image type silver halide emulsion in which latent images are formed mainly in the inside of the silver halide grains.

As gelatin for use in the present invention, gelatin which has been subjected to a deionizing treatment is preferably used. Usually, gelatin contains a large amount of calcium ions, and frequently contains at least 5,000 ppm of calcium ions. In the present invention, it is preferable to use deionized gelatin having a calcium ion content of not more than 500 ppm. The amount of deionized gelatin is preferably at least 10% by weight, more preferably at least 20% by weight, and particularly preferably at least 50% by weight of the total weight of gelatin. Such a gelatin may be used for any layer of the color photographic light-sensitive material of this invention.

The compound represented by formula (I) according to the present invention is conventionally used as anti-color mixing agent in a photographic material and is preferably oil soluble compound. An amount of the compound represented by formula (I) used in the light-insensitive layer, which is formed under the cyan coupler-containing silver halide emulsion layer, is preferably 10 mg/m$^2$ or more, and 40 mg/m$^2$ or less. An amount of the compound represented by formula (I) which does not substantially co-existed with an ultraviolet absorbent in the light-insensitive layer, which is formed over the cyan coupler-containing silver halide emulsion layer, (hereinafter overlayer), is preferably less than 10 mg/m$^2$, and is most preferably zero.

In the compound shown by foregoing formula (I), preferred examples of the substituents shown by $R_{11}$ and $R_{12}$ are an alkyl group, an alkenyl group, an aryl group, an acyl group, a cycloalkyl group, a sulfonic acid group, a halogen atom, and a heterocyclic group.

As the foregoing alkyl group, there are, for example, methyl, ethyl, n-propyl, n-butyl, t-butyl, n-amyl, i-amyl, n-octyl, n-dodecyl, and n-octadecyl and an alkyl group having from 1 to 32 carbon atoms is particularly preferable.

As the alkenyl group, there are, for example, allyl, octenyl, and oleyl. In particular, an alkenyl group having from 2 to 32 carbon atoms is preferred.

As the aryl group, there are, for example, phenyl and naphthyl. As the acyl group, there are, for example, acetyl, octanoyl, and lauroyl. As the halogen atom, there are, for example, fluorine, chlorine, and bromine. As the cycloalkyl group, there are, for example, cyclohexyl. Also, as the heterocyclic group, there are, for example, imidazoyl, furyl, purodyl, triazinyl, and thiazolyl.

In foregoing formula (I), the sum total of the carbon atoms of the groups shown by $R_{11}$ and $R_{12}$ is preferably at least 8, and also it is preferable that the group shown by $R_{11}$ and/or $R_{12}$ is a group capable of imparting a non-diffusibility to the compound.

Examples of the substituents shown by $R_{13}$ and $R_{14}$ in formula (I) described above are a halogen atom, an alkyl group, an aryl group, cycloalkyl group, an alkoxy group, an aryloxy group, an arylthio group, an acyl group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, an alkyl sulfonyl group, an arylsulfonyl group, a nitro group, a cyano group, an alkyloxycarbonyl group, an aryloxycarbonyl group, an alkylacyloxy group, and an aryloxy group.

Examples of the halogen atom, the alkyl group, the aryl group, the acyl group, and the cycloalkyl group shown by $R_{13}$ and $R_{14}$ in foregoing formula (I) are same as those illustrated above in regard to $R_{11}$ and $R_{12}$.

As the alkoxy group shown by $R_{13}$ and $R_{14}$, there are, for example, methoxy, ethoxy, and dodecyloxy. As the aryloxy group, there is, for example, phenoxy. As the alkylthio group, there are, for example, methylthio, n-butylthio, and n-dodecylthio.

As the arylthio group, there is, for example, phenylthio. As the alkylacylamino group, there is, for example, acetylacylamino. As the arylacylamino group, there is, for example, benzoylamino. As the alkylcarbamoyl group, there is, for example, methylcarbamoyl. As the arylcarbamoyl group, there is, for example, phenylcarbamoyl. As the alkylsulfonamido group, there is, for example, methylsulfonamido. As the arylsulfonamido group, there is, for example, phenylsulfonamido. As the alkylsulfamoyl group, there is, for example, methylsulfamoyl. As the arylsulfamoyl group, there is, for example, phenylsulfamoyl. As the alkyloxycarbonyl group, there is, for example, methyloxycarbonyl. As the aryloxycarbonyl group, there is, for example, phenyloxycarbonyl. As the alkylacryloxy group, there is, for example, acetyloxy. As the arylacyloxy group, there is, for example, benzoyloxy.

These substituents may be further substituted with an alkyl group, an aryl group, an aryloxy group, an alkylthio group, a cyano group, an acyloxy group, an alkoxycarbonyl group, an acyl group, a sulfamoyl group, a hydroxy group, a nitro group, a heterocyclic group, etc.

Specific examples of the compound shown by formula (I) are illustrated below.

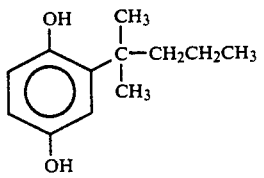

(I-1)

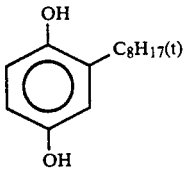

(I-2)

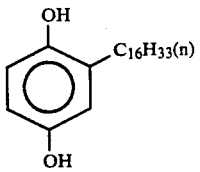

(I-3)

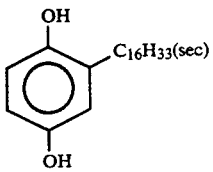

(I-4)

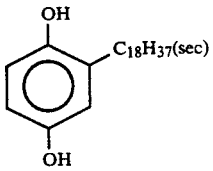

(I-5)

-continued

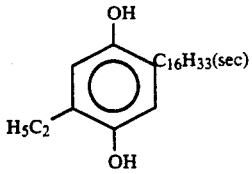

(I-6)

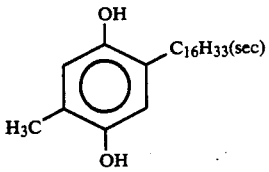

(I-7)

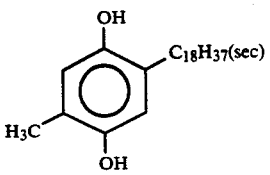

(I-8)

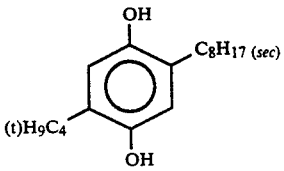

(I-9)

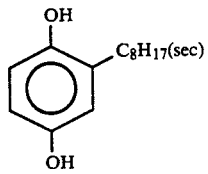

(I-10)

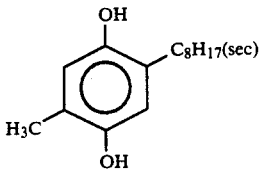

(I-11)

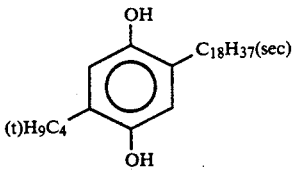

(I-12)

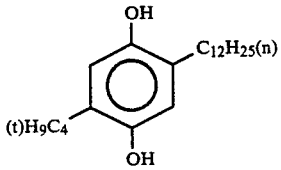

(I-13)

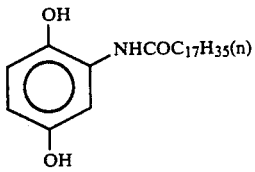

(I-14)

-continued (I-15)

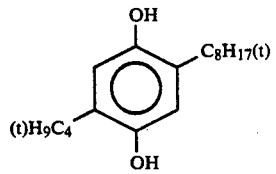

(I-16)

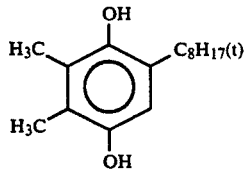

(I-17)

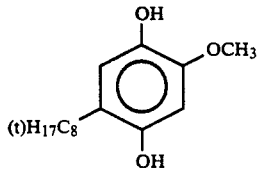

(I-18)

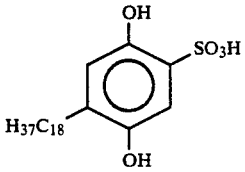

(I-19)

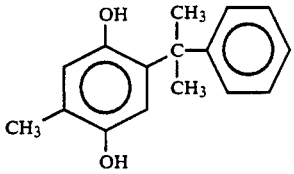

(I-20)

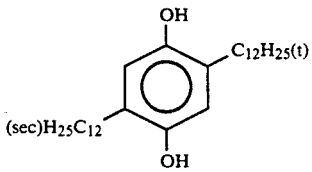

(I-21)

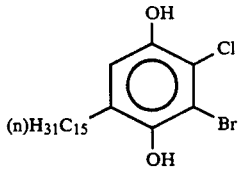

(I-22)

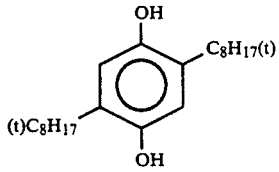

(I-23)

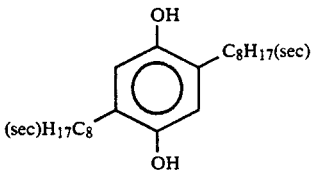

-continued (I-24)

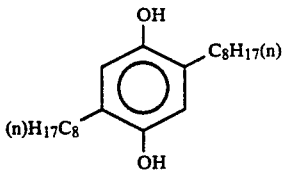

It is preferable that the light-insensitive layer under the cyan coupler-containing emulsion layer contains at least one compound shown by the foregoing formula (I), and also it is preferable that the compound of formula (I) is present in the layer as an emulsified dispersion in which the compound of formula (I) is dissolved in a high-boiling organic solvent. Furthermore, it is also preferable that the light-insensitive layer contains the compound of formula (I) together with a high molecular weight compound such as a polyacrylamide.

Also, as the ultraviolet absorbent in the layer over the cyan coupler-containing emulsion layer, any ultraviolet absorbent can be used, but preferable ultraviolet absorbents are thiazolidone series, benzotriazole series, acrylonitrile series, benzophenone series, and aminobutadiene series ultraviolet absorbents. These ultraviolet absorbents are described, e.g., in U.S. Pat. Nos. 1,023,859, 2,685,512, 2,739,888, 2,784,087, 2,748,021, 3,004,896, 3,052,636, 3,215,530, 3,253,921, 3,533,794, 4,692,525, 3,705,805, 3,707,375, and 3,754,919 and British Patent 1,321,355.

From these compounds, benzotriazole series compounds are more preferable and in particular, 2-(2'-hydroxyphenyl)benzotriazole series compounds represented by the following formula (II) are preferred. These compounds may be in a solid state or liquid state at normal temperature.

(II)

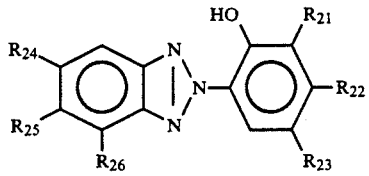

Examples of liquid ultraviolet absorbents are described in JP-B-55-36984, JP-B-55-12587 (the term "JP-B" as used herein means an "examined published Japanese patent application"), and JP-A-58-214152.

Details of the atoms and groups shown by $R_{21}$, $R_{22}$, $R_{23}$, $R_{24}$, $R_{25}$, and $R_{26}$ of the ultraviolet absorbents shown by formula (II) are described in JP-A-58-221844, JP-A-59-46646, JP-A-59-109055, JP-B-36-10466, JP-B-42-26187, JP-B-48-5496, and JP-B-48-41572 (the term "JP-B" as shown herein means an "examined published Japanese patent application"), U.S. Pat. Nos. 3,754,919 and 4,220,711.

Examples of the compounds shown by foregoing formula (II) are illustrated in Table 1 below, but the invention is not limited to these compounds.

TABLE 1

| UV No. | $R_{24}$ | $R_{25}$ | $R_{22}$ | $R_{21}$ | $R_{23}$ |
|---|---|---|---|---|---|
| | | | (II-a) ($R_{26}$ = H) | | |
| 1 | H | H | H | H | H |
| 2 | H | H | H | H | $CH_3$ |
| 3 | H | H | H | H | (t)$C_4H_9$ |
| 4 | H | H | H | H | (s)$C_5H_{11}$ |
| 5 | H | H | H | H | (t)$C_5H_{11}$ |
| 6 | H | H | H | H | 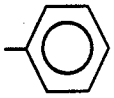 |
| 7 | H | H | H | H | (n)$C_5H_{11}$ |
| 8 | H | H | H | H | (n)$C_8H_{17}$ |
| 9 | H | H | H | H | (i)$C_8H_{17}$ |
| 10 | H | H | H | H | (t)$C_8H_{17}$ |
| 11 | H | H | H | H | (n)$C_{12}H_{25}$ |
| 12 | H | H | H | H | (n)$C_{16}H_{33}$ |
| 13 | H | H | H | H | $OCH_3$ |
| 14 | H | H | H | H | $C_2H_4COOC_8H_{17}$(n) |
| 15 | H | H | H | H | $CONHC_{12}H_{25}$(n) |
| 16 | H | H | H | $CH_3$ | (s)$C_4H_9$ |
| 17 | H | H | H | $CH_3$ | (t)$C_4H_9$ |
| 18 | H | H | H | (s)$C_4H_9$ | (s)$C_4H_9$ |
| 19 | H | H | H | (s)$C_4H_9$ | (t)$C_4H_9$ |
| 20 | H | H | H | (t)$C_4H_9$ | (s)$C_4H_9$ |
| 21 | H | H | H | (t)$C_4H_9$ | (t)$C_4H_9$ |
| 22 | H | H | H | (t)$C_4H_9$ | (s)$C_{12}H_{25}$ |
| 23 | H | H | H | (t)$C_4H_9$ | $C_2H_4COOC_8H_{17}$(n) |
| 24 | H | H | H | (t)$C_5H_{11}$ | (t)$C_5H_{11}$ |
| 25 | H | H | H | (t)$C_5H_{11}$ | $C_6H_5$ |
| 26 | H | H | H | (t)$C_5H_{11}$ | 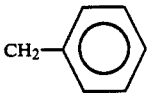 |
| 27 | H | H | H | Cl | Cl |
| 28 | H | H | H | $CH_2NHCOOC_5H_{11}$(n) | H |
| 29 | H | Cl | H | H | (t)$C_5H_{11}$ |
| 30 | H | Cl | H | H | 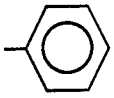 |
| 31 | H | Cl | H | H | $C_6H_{11}$(cycl.) |
| 32 | H | Cl | H | H | $C_2H_4COOC_8H_7$ (i + sec) |
| 33 | H | Cl | H | H | Cl |
| 34 | H | Cl | H | (s)$C_4H_9$ | (s)$C_4H_9$ |
| 35 | H | Cl | H | (s)$C_4H_9$ | (t)$C_4H_9$ |
| 36 | H | Cl | H | (t)$C_4H_9$ | $CH_3$ |
| 37 | H | Cl | H | (t)$C_4H_9$ | $CH_2CH{=}CH_2$ |
| 38 | H | Cl | H | (t)$C_4H_9$ | (s)$C_4H_9$ |
| 39 | H | Cl | H | (t)$C_4H_9$ | (t)$C_4H_9$ |
| 40 | H | Cl | H | (t)$C_4H_9$ | $C_6H_{11}$(cycl.) |
| 41 | H | Cl | H | (t)$C_4H_9$ | $C_2H_4COOC_8H_{17}$ |
| 42 | H | Cl | H | (n)$C_5H_{11}$ | 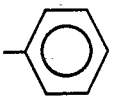 |
| 43 | H | Cl | H | $CH_2N$(t)$C_4H_9$ / $CH_3$ | H |
| 44 | H | $SOOC_2H_5$ | H | $CH_3$ | $CH_3$ |
| 45 | H | $CH_3$ | H | H | (i)$C_8H_{17}$ |
| 46 | H | $CH_3$ | H | H | $OCH_3$ |
| 47 | H | $CH_3$ | H | (s)$C_4H_9$ | (s)$C_4H_9$ |
| 48 | H | $CH_3$ | H | (s)$C_4H_9$ | (t)$C_4H_9$ |

TABLE 1-continued

| UV No. | $R_{24}$ | $R_{25}$ | $R_{22}$ | $R_{21}$ | $R_{23}$ |
|---|---|---|---|---|---|
| 49 | H | $CH_3$ | H | (t)$C_5H_{11}$ | 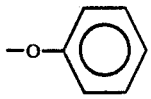 |
| 50 | H | $CH_3$ | H | Cl | (n)$C_8H_{17}$ |
| 51 | H | $C_2H_5$ | H | (i)$C_3H_7$ | (i)$C_3H_7$ |
| 52 | H | (n)$C_4H_9$ | H | (s)$C_4H_9$ | (s)$C_4H_9$ |
| 53 | H | (n)$C_4H_9$ | H | (s)$C_4H_9$ | (t)$C_4H_9$ |
| 54 | H | (n)$C_4H_9$ | H | (s)$C_4H_9$ | (t)$C_5H_{11}$ |
| 55 | H | (s)$C_4H_9$ | H | (t)$C_4H_9$ | (t)$C_4H_9$ |
| 56 | H | (s)$C_4H_9$ | H | (t)$C_4H_9$ | (t)$C_5H_{11}$ |
| 57 | H | (s)$C_4H_9$ | H | (t)$C_4H_9$ | $C_2H_4COOC_8H_{17}$(n) |
| 58 | H | (s)$C_4H_9$ | H | (t)$C_5H_{11}$ | (t)$C_5H_{11}$ |
| 59 | H | (t)$C_4H_9$ | H | (s)$C_4H_9$ | (t)$C_4H_9$ |
| 60 | H | (t)$C_4H_9$ | H | (s)$C_4H_9$ | (t)$C_4H_9$ |
| 61 | H | (t)$C_4H_9$ | H | (s)$C_4H_9$ | (t)$C_5H_{11}$ |
| 62 | H | (t)$C_4H_9$ | H | (t)$C_4H_9$ | (t)$C_4H_9$ |
| 63 | H | (n)$C_5H_{11}$ | H | (s)$C_4H_9$ | (t)$C_4H_9$ |
| 64 | H | (t)$C_5H_{11}$ | H | (s)$C_4H_9$ | (t)$C_4H_9$ |
| 65 | H | (t)$C_5H_{11}$ | H | (t)$C_5H_{11}$ | (t)$C_5H_{11}$ |
| 66 | H | $C_6H_5$ | H | (t)$C_4H_9$ | (t)$C_4H_9$ |
| 67 | H | $C_6H_5$ | H | (t)$C_5H_{11}$ | (t)$C_5H_{11}$ |
| 68 | H | (n)$C_8H_{17}$ | H | H | (i)$C_8H_{17}$ |
| 69 | H | OH | H | (t)$C_4H_9$ | (t)$C_4H_9$ |
| 70 | H | $OCH_3$ | H | H | $OC_8H_{17}$(s) |
| 71 | H | $OCH_3$ | H | (s)$C_4H_9$ | (s)$C_4H_9$ |
| 72 | H | $OCH_3$ | H | (s)$C_4H_9$ | (t)$C_4H_9$ |
| 73 | H | $OCH_3$ | H | (t)$C_5H_{11}$ | (t)$C_5H_{11}$ |
| 74 | H | $OCH_3$ | H | (t)$C_5H_{11}$ | 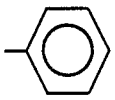 |
| 75 | H | $OCH_3$ | H | Cl | Cl |
| 76 | H | $OC_2H_5$ | H | (s)$C_4H_9$ | (t)$C_4H_9$ |
| 77 | H | $OC_4H_9$(n) | H | Cl | $OCH_3$ |
| 78 | H | 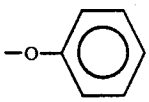 | H | (t)$C_5H_{11}$ | (t)$C_5H_{11}$ |
| 79 | H | $COOC_4H_9$(n) | H | (n)$C_4H_9$ | (t)$C_5H_{11}$ |
| 80 | H | $NO_2$ | H | (n)$C_8H_{17}$ | $OCH_3$ |
| 81 | H | H | Cl | H | Cl |
| 82 | H | H | $OC_5H_{17}$(n) | H | H |
| 83 | H | $CH_3$ | $CH_3$ | H | $CH_3$ |
| 84 | H | Cl | (n)$C_{15}H_{31}$ | H | H |
| 85 | $CH_3$ | $OC_4H_9$(n) | H | H | H |
| 86 | $CH_3$ | $OC_9H_{19}$(n) | H | H | H |
| 87 | $CH_3$ | $OC_{12}H_{25}$(n) | H | H | H |
| 88 | Cl | Cl | H | H | H |
| 89 | $OCH(CH_3)_2$ | Cl | H | H | H |
| 90 | $OCH(CH_3)_2$ | Cl | H | H | $CH_3$ |
| 91 | $OCH(CH_3)_2$ | $OC_2H_3(CH_3)_2$ | H | H | H |
| 92 | $OC_4H_9$(n) | $OC_4H_9$(n) | H | H | H |
| 93 | $OC_4H_9$(n) | $OC_4H_9$(n) | H | H | $OCH_3$ |
| | | (II-b) ($R_{22}$ = H, $R_{25}$ and $R_{26}$ are bonded to each other to form a benzene ring.) | | | |
| 94 | H | | | H | $CH_3$ |
| 95 | H | | | H | (t)$C_8H_{17}$ |
| 96 | H | | | (t)$C_4H_9$ | (t)$C_4H_9$ |
| 97 | Cl | | | H | $C_2H_5$ |

The amount of ultraviolet absorbent present in the light-insensitive layer formed over the cyan coupler-containing silver halide emulsion layer is from 1000 mg/m$^2$ to 150 mg/m$^2$ and preferably from 600 mg/m$^2$ to 150 mg/m$^2$ of light sensitive material.

In the present invention, it is necessary that the light-insensitive layer which is disposed under the cyan coupler-containing silver halide emulsion layer and which contains the compound shown by formula (I) (hereafter "underlayer") does not substantially contain an ultraviolet absorbent. The term "does not substantially contain" means that the amount of ultraviolet absorbent in the underlayer is less than 150 mg/m$^2$, and preferably less than 100 mg/m$^2$ of light sensitive material. It is particularly preferred that no ultraviolet absorbent is present in the underlayer.

An ultraviolet absorbent is preferably present in the cyan coupler-containing silver halide emulsion layer for stabilizing the cyan color images formed.

The light-insensitive layer formed over the cyan coupler-containing silver halide emulsion layer may further contain a stain inhibitor, a stabilizer for the ultraviolet absorbent, etc., in addition to the ultra-violet absorbent, and these additives may be present in the layer as an emulsified dispersion in which the additives are dissolved in a high-boiling organic solvent.

In the present invention, a yellow coupler, a magenta coupler, and a cyan coupler, which form yellow, magenta, or cyan colors, respectively, by coupling with an oxidation product of an aromatic amino color developing agent are used.

Preferred examples of the cyan coupler represented by formula (C) described above which preferably contains 0.1 to 1.0 mol/mol of silver halide, and more preferably 0.1 to 0.5 mol/mol of silver halide are as follows.

In formula (C), $R_1$ is preferably a substituted or un-substituted alkyl group or a substituted or un-substituted aryl group, and is particularly preferably an alkyl group substituted by a substituted aryloxy group.

In formula (C), $R_2$ is preferably an alkyl group having from 2 to 15 carbon atoms or a methyl group having a substituent containing 1 or more carbon atoms and as the substituent, an arylthio group, an alkylthio group, an acylamino group, an aryloxy group, or an alkyloxy group is preferable.

In formula (C), $R_2$ is more preferably an alkyl group having from 2 to 15 carbon atoms, and particularly preferably an alkyl group having from 2 to 4 carbon atoms.

Specific examples of $R_2$ in formula (C) are ethyl, propyl, butyl, pentadecyl, tert-butyl, cyclohexyl, oyclohexylmethyl, phenylthiomethyl, dodecyloxyphenylthiomethyl, butaneamidomethyl, and methoxymethyl. In formula (C), $R_3$ is preferably a hydrogen atom or a halogen atom, and particularly preferably chlorine or fluorine.

In formula (C), Y is preferably a hydrogen atom, a halogen atom, an alkoxy group, an aryloxy group, an acyloxy group, or a sulfonamido group.

Specific examples of the compound shown by formula (C) are illustrated below.

(C-1)

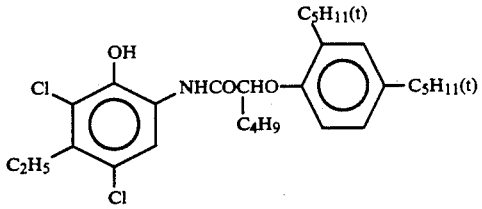

(C-2)

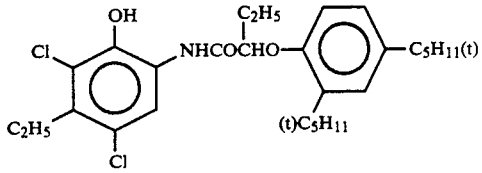

-continued (C-3)

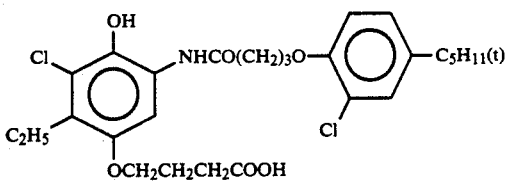

(C-4)

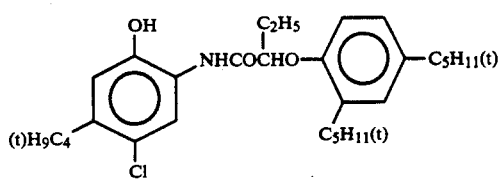

(C-5)

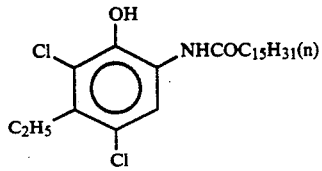

(C-6)

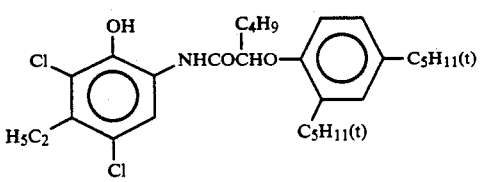

(C-7)

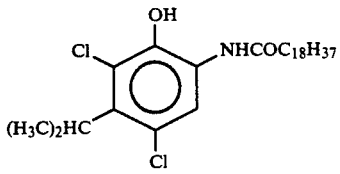

(C-8)

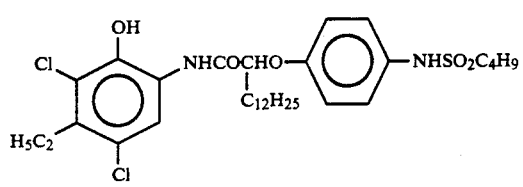

It is preferred that in the color photographic light-sensitive material of the present invention, a hydrophilic colloid layer thereof contains a dye (in particular, an oxonol series dye) capable of being decolored by processing as described in European Patent (EP) 0,337,490A2 such that the optical reflection density of the color photographic material at 680 nm becomes at least 0.70, and also a hydrophobic resin layer of the support contains at least 12% by weight (more preferably at least 14% by weight) titanium oxide surface-treated with a dihydric to tetrahydric alcohol (e.g., trimethylolethane).

It is preferable that the photographic additives for use in the present invention, such as cyan couplers, magenta couplers, yellow couplers, etc., are present in the form of an emulsified dispersion in which the additives are dissolved in a high-boiling organic solvent. As the high-boiling organic solvent, an organic solvent having a melting point of not higher than 100° C. and a boiling point of at least 140° C., which is immiscible with water and is a good solvent for couplers, can be used. The melting point of the high-boiling organic solvent is preferably not higher than 80° C. Also, the boiling point of the high-boiling organic solvent is preferably at least 160° C., and more preferably at least 170° C.

Details of the high-boiling organic solvent are described in JP-A-62-215272, page 137, right lower column to page 144, right upper column.

Also, the cyan, magenta, or yellow coupler can be dispersed by emulsification in an aqueous hydrophilic colloid solution in the form of a loadable latex polymer (described, e.g., in U.S. Pat. No. 4,203,716) impregnated with the coupler in the presence or absence of the foregoing high-boiling organic solvent or can be dispersed in the aqueous hydrophilic colloid in the form of a solution of the coupler and a polymer which is insoluble in water and soluble in an organic solvent.

As the foregoing polymer, the homopolymers or copolymers described in U.S. Pat. No. 4,857,449, column 7 to column 15 and PCT(WO) 88/00723 are used, more preferably a methacrylate series or acrylamide series polymer, and particular preferably an acrylamide series polymer is used for purposes of color image stabilization.

Also, it is preferable that for the color photographic material of the present invention, a color image storage stability improving compound as described in European Patent (EP) 0,277,589A2 is used together with a coupler. In particular, the use of the foregoing color image storage stability compound together with a pyrazoloazole coupler is preferred.

That is, the use of a compound which forms a chemically inactive and substantially colorless compound by chemically bonding with an aromatic amino color developing agent remaining after color development and/or a compound which forms a chemically inactive and substantially colorless compound by chemically bonding with the oxidation product of an aromatic amino color developing agent remaining after color development is preferable for preventing the occurrence of stains and other side reactions caused by the formation of colored dyes by the reaction of an aromatic amino color developing agent or the oxidation product thereof remaining in the photographic emulsion layers and couplers during the storage of the color photographic material after processing.

Also, it is preferable that the color photographic material of the present invention contains antifungal agents such as described in JP-A-63-271247 for preventing the generation of various fungi and bacteria, which grow in the hydrophilic colloid layers and deteriorate the color images formed.

Furthermore, as a support which can be used for the color photographic light-sensitive material of the present invention, a white color polyester series support for display or a support having a layer containing a white pigment on the side containing silver halide emulsion layers may be used. Moreover, for improving the sharpness of the color .images formed, it is preferred to form an antihalation layer on the support at the side containing the silver halide emulsion layers or the back side thereof. In particular, for enabling observation of the display by both reflected light and transmitted light, it is preferred to select the transmission density of the support to be from 0.35 to 0.8.

The color photographic material of the present invention may be exposed by visible light or infrared light. As the light exposure method, a low illuminance exposure or a high-illuminance short-time exposure may be used, and in particular, in the latter case, a laser scanning exposure system wherein the exposure time is shorter than $10^{-4}$ second is preferred.

Also, during light exposure, it is preferable to use a band stop filter described in U.S. Pat. No. 4,880,726 and by using the filter, light color mixing is removed and color reproducibility is remarkably improved.

It is preferable that the color photographic light-sensitive material of the present invention is subjected, after light exposure, to a color development, a blix (bleach-fix), and a wash (or stabilization). The bleach and fix may be separately carried out in place of a single bath (blix) processing. By using the color photographic light-sensitive material of the present invention, the processing from the color development to the wash step (or the stabilization step) can be carried out in 4 minutes or less, and more preferably in 3 minutes or less.

The silver halide emulsions, and other materials (additives, etc.) which can be present in the color photographic materials, photographic layer constructions (dispositions of photographic layers, etc.), processing methods which are applied for processing the color photographic material of the present invention, and additives for processing for use with the photographic material of the present invention include those described, e.g., in the following patent publications, and, in particular, European Patent EPO 355,660A2 (JP-A-2-139544).

| Photographic element | JP-A-62-215272 | JP-A-2-33144 | EP 0355660A2 |
|---|---|---|---|
| Silver halide emulsion | p. 10, right upper column, line 6 to p. 12, left lower column, line 5, and p. 12, right lower column, line 4 from bottom to p. 13, left upper column, line 17. | p. 28, right upper column, line 16 to p. 29, right lower column, line 11, and p. 30, lines 2 to 5. | p. 45, line 53 to p. 47, line 3, and p. 47, lines 20 to 22. |
| Silver halide solvent | p. 12, left lower column, line 6 to 14, and p. 13, left upper column, line 3 from bottom to p. 18, left lower column, last line. | — | — |
| Chemical sensitizer | p. 12, left lower column, line 3 from bottom to right lower column, line 5 from bottom, and p. 18, right lower column, line 1 to p. 22, right upper column, line 9 from bottom. | p. 29, right lower column, line 12 to last line. | p. 47, lines 4 to 9. |
| Spectral sensitizer | p. 22, right upper column, line 8 from bottom to | p. 30, left upper column, lines 1 to 13. | p. 47, lines 10 to 15. |

-continued

| Photographic element | JP-A-62-215272 | JP-A-2-33144 | EP 0355660A2 |
|---|---|---|---|
| (spectral sensitizing method) | p. 38, last line. | | |
| Emulsion stabilizer | p. 39, left upper column, line 1 to p. 72, right upper column, last line. | p. 30, left upper column, line 14 to right upper column, line 1. | p. 47, lines 16 to 19. |
| Development accelerator | p. 72, left lower column, line 1 to p. 91, right upper column, line 3. | — | — |
| Color coupler (cyan, magenta and yellow couplers) | p. 91, right upper column, line 4 to p. 121, left upper column, line 6. | p. 3, right upper column, line 14 to p. 18, left upper column, last line, and p. 30, right upper column, line 6 to p. 35 right lower column, line 11. | p. 4, lines 15 to 27, p. 5, line 30 to p. 28, last line, and p. 47, line 23 to p. 63, line 50. |
| Color forming accelerator | p. 121, left upper column, line 7 to p. 125, right upper column, line 1. | — | — |
| UV absorber | p. 125, right upper column, line 2 to p. 127, left lower column, last line. | p. 37, right lower column, line 14 to p. 38, left upper column, line 11. | p. 65, lines 22 to 31. |
| Anti-fading agent (an image stabilizer) | p. 127, right lower column, line 1 to p. 137, left lower column, line 8. | p. 36, right upper column, line 12 to p. 37, left upper column, line 19. | p. 4, line 30 to p. 5, line 23, p. 29, line 1 to p. 45, line 25, p. 45, line 33 to 40, and p. 65, lines 2 to 21. |
| High boiling and/or low boiling organic solvent | p. 137, left lower column, line 9 to p. 144, right upper column, last line. | p. 35, right lower column, line 14 to p. 36, left upper, line 4. | p. 64, lines 1 to 51. |
| Method for dispersing photographic additives | p. 144, left lower column, line 1 to p. 146, right upper column, line 7. | p. 27, right lower column, line 10 to p. 28, left upper, last line, and p. 35, right lower column, line 12 to p. 36, right upper column, line 7. | p. 63, line 51 to p. 64, line 56. |
| Hardener | p. 146, right upper column, line 8 to p. 155, left lower column, line 4. | — | — |
| Precursor of a developing agent | p. 155, left lower column, line 5 to right lower column, line 2. | — | — |
| Development inhibitor-releasing compound | p. 155, right lower column, lines 3 to 9. | — | — |
| Support | p. 155, right lower column, line 19 to p. 156, left upper column, line 14. | p. 38, right upper column, line 18 to p. 39, left upper column, line 3. | p. 66, line 29 to p. 67 line 13. |
| Light-sensitive layer structure | p. 156, left upper column, line 15 to right lower column, line 14. | p. 28, right upper column, lines 1 to 15. | p. 45, lines 41 to 52. |
| Dye | p. 156, right lower column, line 15 to p. 184, right lower column, last line. | p. 38, left upper column, line 12 to right upper column, line 7. | p. 66, lines 18 to 22. |
| Anti-color mixing agent | p. 185, left upper column, line 1 to p. 188, right lower column, line 3. | p. 36, right upper column, lines 8 to 11. | p. 64, line 57 to line 1. |
| Gradation controller | p. 188, right lower column, line 4 to 8. | — | — |
| Anti-stain agent | p. 188, right lower column, line 9 to p. 193, right lower column, line 10. | p. 37, left upper oclumn, last line to right lower column, line 13. | p. 65, line 32 to p. 66, line 17. |
| Surface active agent | p. 201, left lower column, line 1 to p. 210, right upper column, last line | p. 18, right upper column, line 1 to p. 24, right lower column, last line, and p. 27, left lower column, line 10 from bottom to right lower column, line 9. | — |
| Fluorinated compound (anti-electrification agent, coating aid, lubricant and anti-adhesion agent) | p. 210, left lower column, line 1 to p. 222, left lower column, line 5. | p. 25, left upper column, line 1 to p. 27, right lower column, line 9. | |
| Binder (hydrophilic | p. 222, left lower column, line 6 to p. 225, left | p. 38, right upper column, lines 8 to 18. | p. 66, lines 23 to 28. |

-continued

| Photographic element | JP-A-62-215272 | JP-A-2-33144 | EP 0355660A2 |
|---|---|---|---|
| colloid) | upper column, last line | | |
| Thickener | p. 225, right upper column, line 1 to p. 227, right upper column, line 2. | — | — |
| Anti-electrification agent | p. 227, right upper column, line 3 to p. 230, left upper column, line 1. | — | — |
| Polymer latex | p. 230, left upper column, line 2 to p. 239, last line | — | — |
| Matting agent | p. 240, left upper column, line 1 to right upper column, last line. | — | — |
| Photographic processing method (processing steps and additives) | p. 3, right upper column, line 7 to p. 10, right upper column, line 5. | p. 39, left upper column, line 4 to p. 42, left upper column, last line. | p. 67, line 14 to p. 69, line 28. |

Remarks:
1. There is included in the cited items of JP-A-62-215272, the subject matter amended according to the Amendment of March 16, 1987.
2. Of the above color couplers, also preferably used are the so-called short wave type yellow couplers described in JP-A-63-231451, JP-A-63-123047, JP-A-63-241547, JP-A-1-173499, JP-A-1-213648, and JP-A-1-250944.

Also, as cyan couplers, the cyan coupler of formula (C) described above may be used together with a diphenylimidazole series cyan coupler described in JP-A-2-33144, a 3-hydroxypyridine series cyan coupler (in particular, the 2-equivalent cyan coupler formed by bonding a chlorine releasing group to the 4-equivalent coupler (42) illustrated as a practical example in JP-A-2-33144, and couplers (6) and (9) of JP-A-2 33144 are preferred), or the cyclic active methylene series cyan coupler (in particularly couplers 3, 8, 34 illustrated as practical examples) described in JP-A-64-32260.

Also, as a processing method for a silver halide color photographic material using a high-silver chloride emulsion having a silver chloride content of at least 90 mol%, the process described described in JP-A-2-207250, page 27, left upper column to page 34, right upper column is preferably used.

The following examples are intended to illustrate more practically the present invention but not to limit it in any way.

EXAMPLE 1

After applying corona discharging treatment to the surfaces of a paper support having laminated on both surfaces polyethylene, a gelatin subbing layer containing sodium dodecylbenzenesulfonate was formed on the support and further various photographic layers shown below were coated thereon to provide a multilayer color photographic paper (Sample 101).

The coating compositions for the photographic layers were prepared as follows.

Preparation of Coating Compositions

In 25 g of solvent (Solv-1) and 25 g of solvent (Solv-2) were dissolved 153.0 g of yellow coupler (ExY), 15.0 g of color image stabilizer (Cpd-1), 7.5 g of color image stabilizer (Cpd-2), and 16.0 g of color image stabilizer (Cpd-3), and the solution obtained was dispersed by emulsification in 1000 g of an aqueous 10% gelatin solution containing 60 ml of an aqueous solution of 10% sodium dodecylbenzenesulfonate and 10 g of citric acid to provide emulsified dispersion A.

On the other hand, silver chloride emulsion B (cubic crystal form, a 6:4 mixture (by silver mol ratio) of a large size emulsion B1 having an average grain size of 0.88 μm and a small size emulsion B2 having an average grain size of 0.70 μm, the variation coefficient of the grain size distribution is 0.08 for emulsion B1 and 0.10 for emulsion B2, each emulsion locally has 0.3 mol% silver bromide at a part of each grain surface) was prepared.

The foregoing emulsified dispersion A was mixed with the silver chloride emulsion B, and the composition of the mixture was adjusted as shown below to provide a coating composition for Layer 1.

The coating compositions for Layer 2 to Layer 7 were also prepared in a similar manner to the method for preparing the coating composition for Layer 1.

In addition, as a gelatin hardening agent for each layer, 1-oxy-3,5-dichloro-s-triazine sodium salt was used. Also, Cpd-15 and Cpd-16 were added to each layer in amounts of 25.0 mg/M$^2$ and 50.0 mg/M$^2$, respectively.

Also, for the silver chloride emulsion of each light-sensitive silver halide emulsion layer, the following spectral sensitizing dyes were used.

Blue-Sensitive Emulsion Layer

Sensitizing Dye A

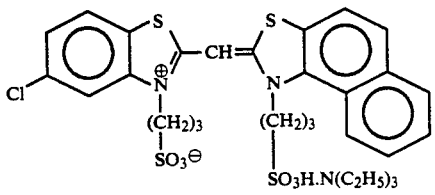

and

Sensitizing Dye B

-continued

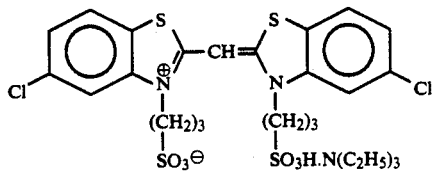

($2.0\times10^{-4}$ mole each per mole of silver halide to the large grain size emulsion and $2.5\times10^{-4}$ mole each per mole of silver halide to the small grain size emulsion).

Green-Sensitive Emulsion Layer

Sensitizing Dye C

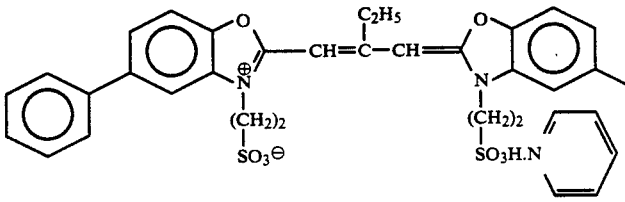

($4.0\times10^{-4}$ mole per mole of silver halide to the large grain size emulsion and $5.6\times10^{-4}$ mole per mole of silver halide to the small grain size emulsion).

Sensitizing Dye D

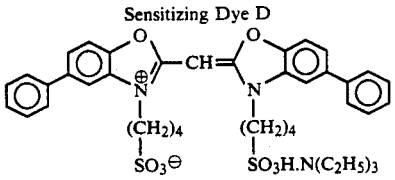

($7.0\times10^{-5}$ mole per mole of silver halide to the large grain size emulsion and $1.0\times10^{-4}$ mole per mole of silver halide to the small grain size emulsion).

Red-Sensitive Emulsion Layer

Sensitizing Dye E

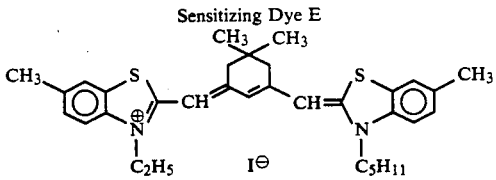

($0.9\times10^{-4}$ mole per mole of silver halide to the large grain size emulsion and $1.1\times10^{-4}$ mole per mole of silver halide to the small grain size emulsion).

Furthermore, the following compound A was added into the red-sensitized layer in an amount of $2.6\times10^{-3}$ mol per mol of silver halide.

Compound A

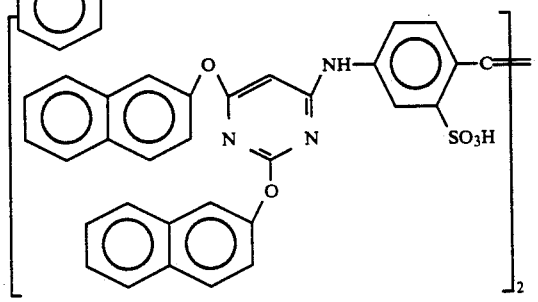

Also, to the blue-sensitive emulsion layer, the green-sensitive emulsion layer, and the red-sensitive emulsion layer, there was added 1-(5-methylureidophenyl)-5-mercaptotetrazle in an amount of $3.4\times10^{-4}$ mol, $9.7\times10^{-4}$ mol, and $5.5\times10^{-4}$ mol, respectively per mol of silver halide.

Also, to the blue-sensitive emulsion layer and the green-sensitive emulsion layer, there was added 4-hydroxy-6-methyl-1,3,3a,7-teraazaindene in an amount of $1\times10^{-4}$ mol and $2\times10^{-4}$ mol per mol of silver halide.

Furthermore, for preventing irradiation, the following dyes (the numeral in each parenthesis shows the coated amount) were added to each of the silver halide emulsion layers.

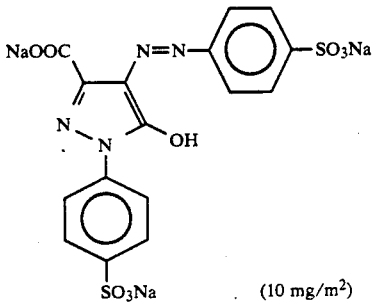

(10 mg/m²)

-continued

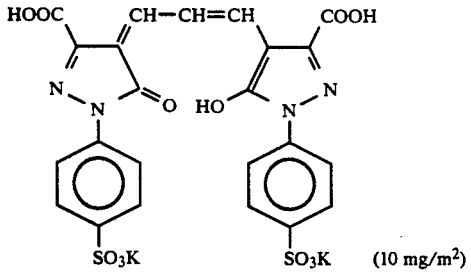

(10 mg/m²)

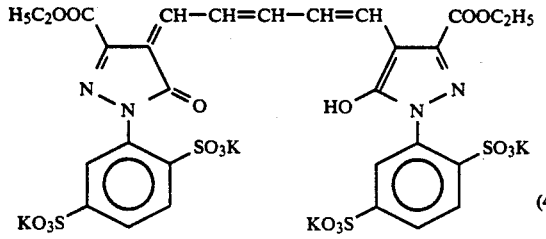

(40 mg/m²)

and

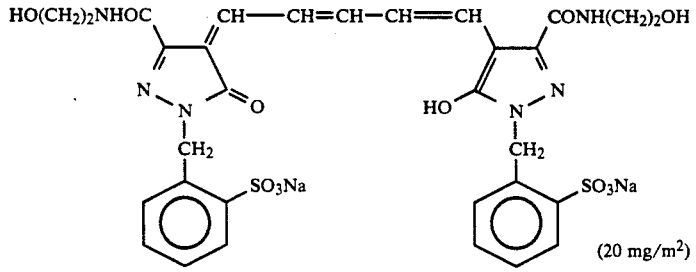

(20 mg/m²)

Layer Structure

Then, the composition of each layer is shown below. In addition, the numerals show the coated amounts (g/m²). The coated amounts of the silver halide emulsions are expressed in terms of the amount converted to silver.

Support

Polyethylene-coated paper (the polyethylene coating at the emulsion layer side of the support contained a while pigment ($TiO_2$) and a bluish dye (ultramarine blue)).

| | Coated Amounts |
|---|---|
| Layer 1 (Blue-Sensitive Emulsion Layer) | |
| Foregoing Silver Chloride Emulsion B | 0.27 |
| Gelatin | 1.36 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.13 |
| Solvent (Solv-2) | 0.13 |
| Layer 2 (Color Mixing Inhibiting Layer) | |
| Gelatin | 0.99 |
| Color Mixing Inhibitor (Cpd-4) | 0.08 |
| Solvent (Solv-2) | 0.25 |
| Solvent (Solv-3) | 0.25 |
| Layer 3 (Green-Sensitive Emulsion Layer) | |
| Silver Chlorobromide Emulsion (cubic, 6:4 mixture (Ag mol ratio) of a large size emulsion G1 having an average grain | 0.13 |

-continued

| | Coated Amounts |
|---|---|
| size of 0.55 μm and a small size emulsion G2 having an average grain size of 0.39 μm, variation coeffs. of grain size distribution 0.10 and 0.08, respectively, each emulsion contained grains in which 0.8 mol % AgBr was localized on a part of the grain surface) | |
| Gelatin | 1.45 |
| Magenta Coupler (ExM) | 0.16 |
| Color Image Stabilizer (Cpd-6) | 0.15 |
| Color Image Stabilizer (Cpd 2) | 0.03 |
| Color Image Stabilizer (Cpd-7) | 0.01 |
| Color Image Stabilizer (Cpd-8) | 0.01 |
| Color Image Stabilizer (Cpd-9) | 0.08 |
| Solvent (Solv-3) | 0.50 |
| Solvent (Solv-4) | 0.15 |
| Solvent (Solv-5) | 0.15 |
| Layer 4 (Color Mixing Inhibiting Layer) | |
| Gelatin | 0.70 |
| Color Mixing Inhibitor (Cpd-4) which is the same as (I-22) | 0.04 |
| Color Image Stabilizer (Cpd-5) | 0.02 |
| Solvent (Solv-2) | 0.18 |
| Solvent (Solv-3) | 0.18 |
| Layer 5 (Red-Sensitive Emulsion Layer) | |
| Silver Chlorobromide Emulsion (cubic, 7:3 mixture (Ag mol ratio) of a large size emulsion R1 having an average grain size of 0.58 μm and a small size emulsion R2 having an average grain size of 0.45 μm, variation coeffs. of grain size distribution 0.09 and 0.11, respectively, each emulsion contained grains in which 0.6 mol % AgBr was localized on a part of the grain surface) | 0.20 |

-continued

| | Coated Amounts |
|---|---|
| Gelatin | 0.85 |
| Cyan Coupler (ExC) | 0.33 |
| Ultraviolet Absorbent (UV-2) | 0.18 |
| Color Image Stabilizer (Cpd-1) | 0.40 |
| Color Image Stabilizer (Cpd-10) | 0.15 |
| Color Image Stabilizer (Cpd-11) | 0.15 |
| Color Image Stabilizer (Cpd-12) | 0.01 |
| Color Image Stabilizer (Cpd-9) | 0.01 |
| Color Image Stabilizer (Cpd-8) | 0.01 |
| Solvent (Solv-6) | 0.22 |
| Solvent (Solv-1) | 0.01 |
| Layer 6 (Ultraviolet Absorption Layer) | |
| Gelatin | 0.55 |
| Ultraviolet Absorbent (UV-1) | 0.40 |
| Color Image Stabilizer (Cpd-13) | 0.15 |
| Color Image Stabilizer (Cpd-6) | 0.02 |
| Layer 7 (Protective Layer) | |
| Gelatin | 1.13 |
| Acryl-Modified Copolymer (modification degree 17%) of Polyvinyl Alcohol | 0.15 |
| Liquid Paraffin | 0.03 |
| Color Image Stabilizer (Cpd-14) | 0.01 |

The compounds used for making the above color photographic paper are shown below.

(ExY) Yellow Coupler:

A 1:1 mixture (mol ratio) of

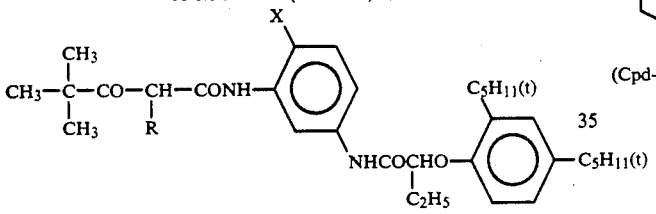

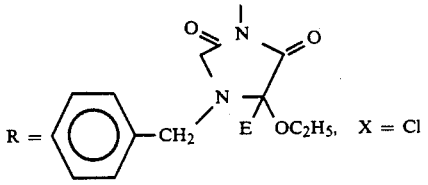

and

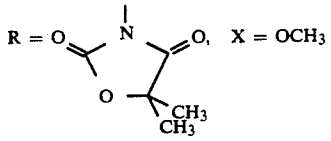

(ExM) Magenta Coupler:

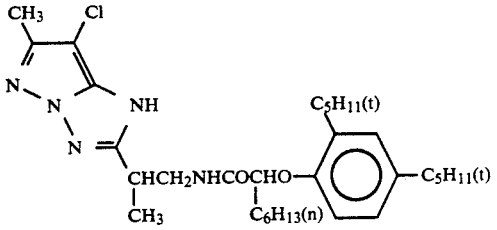

(ExC) Cyan Coupler :

-continued

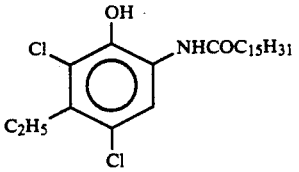

(Cpd-1) Color Image Stabilizer:

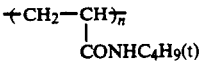

(Average mol. weight: 60,000)

(Cpd-2) Color Image Stabilizer:

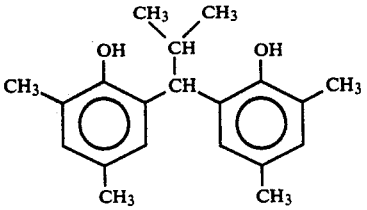

(Cpd-3) Color Image Stabilizer:

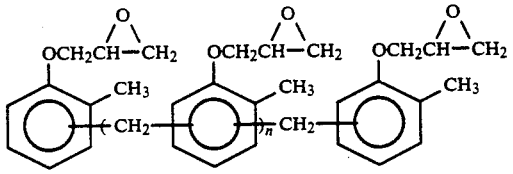

n = 7–8 (on average)

(Cpd-4) Color Mixing Inhibitor:

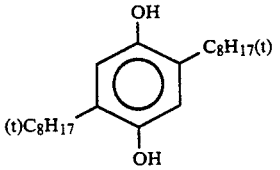

(Cpd-5) Color Image Stabilizer:

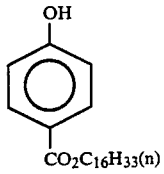

(Cpd-6) Color Image Stabilizer:

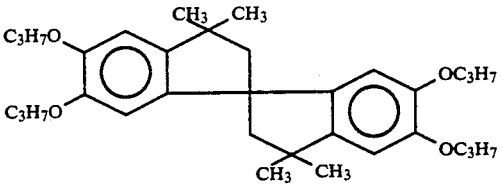

(Cpd-7) Color Image Stabilizer:

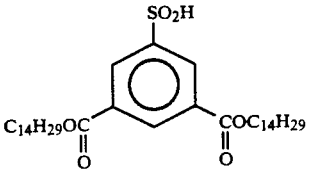

(Cpd-8) Color Image Stabilizer:

-continued

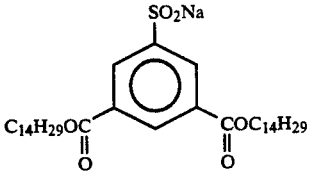

(Cpd-9) Color Image Stabilizer:

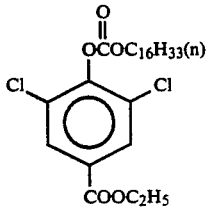

(Cpd-10) Color Image Stabilizer:

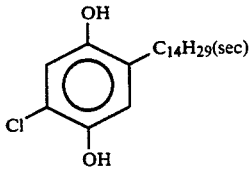

(Cpd-11) Color Image Stabilizer:

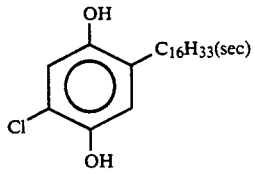

(Cpd-12) Color Image Stabilizer:

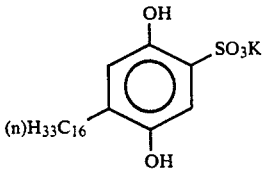

(Cpd-13) Color Image Stabilizer:

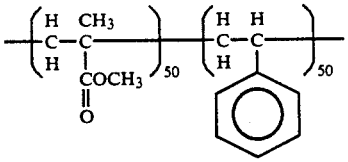

Average mol. weight: about $6.0 \times 10^4$ (Cpd-14) Color Image Stabilizer:

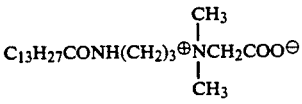

(Cpd-15) Antiseptic:

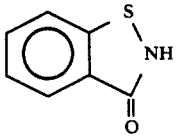

(Cpd-16) Antiseptic:

-continued

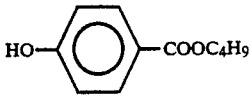

(UV-1) Ultraviolet Absorbent:

A 10:5:1:5 (by weight ratio) mixture of following (1) (2) (3) (4).

(1)

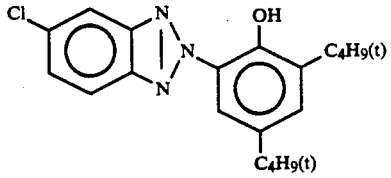

(2)

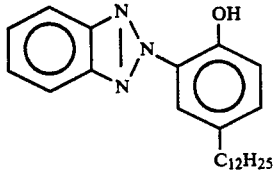

(3)

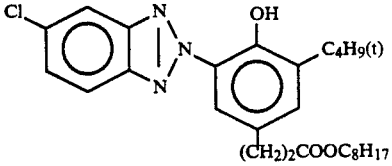

(Solv-1) Solvent:

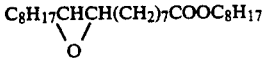

(Solv-2) Solvent:

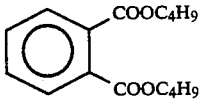

(Solv-3) Solvent:

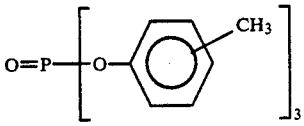

(Solv-4) Solvent:

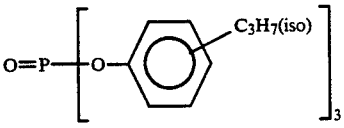

(Solv-5) Solvent:

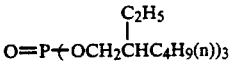

(Solv-6) Solvent:

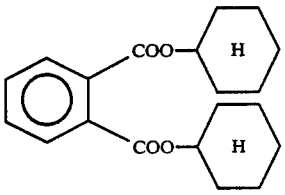

Furthermore, Samples 102 to 110 were prepared in the same manner as Sample 101, except that the compositions of Layer 4 and Layer 6 were changed as shown in Table 2.

TABLE 2

| Sample No. | 101 | 102 | 103 | 104 | 105 | 106 | 107 | 108 | 109 | 110 |
|---|---|---|---|---|---|---|---|---|---|---|
| Fourth Layer | | | | | | | | | | |
| Gelatin | 0.70 | 0.70 | 0.70 | 0.70 | 0.70 | 0.95 | 1.03 | 1.03 | 1.03 | 1.03 |
| Color mixing Inhibitor (Cpd-4) | 0.04 | 0.04 | 0.04 | 0.04 | 0.04 | 0.04 | 0.04 | 0.04 | 0.04 | 0.04 |
| Color Image Stabilizer (Cpd-5) | 0.02 | 0.02 | 0.02 | 0.02 | 0.02 | 0.02 | 0.02 | 0.02 | 0.02 | 0.02 |
| Solvent (Solv-2) | 0.18 | 0.18 | 0.18 | 0.18 | 0.18 | 0.18 | 0.18 | 0.18 | 0.18 | 0.18 |
| Solvent (Solv-3) | 0.18 | 0.18 | 0.18 | 0.18 | 0.18 | 0.18 | 0.18 | 0.18 | 0.18 | 0.18 |
| Ultraviolet Absorbent (UV-1) | 0 | 0 | 0 | 0 | 0 | 0.15 | 0.20 | 0.20 | 0.20 | 0.20 |
| Sixth Layer | | | | | | | | | | |
| Gelatin | 0.55 | 0.50 | 0.41 | 0.61 | 0.57 | 0.45 | 0.35 | 0.37 | 1.10 | 1.10 |
| Ultraviolet Absorbent (UV-1) | 0.40 | 0.36 | 0.30 | 0.44 | 0.40 | 0.25 | 0.20 | 0.20 | 0.40 | 0.40 |
| Color Image Stabilizer (Cpd-13) | 0.15 | 0.14 | 0.11 | 0.17 | 0.15 | 0.15 | 0.15 | 0.15 | 0.30 | 0.30 |
| Color Image Stabilizer (Cpd-8) | 0.02 | 0.02 | 0.02 | 0.02 | 0.02 | 0.02 | 0.02 | 0.02 | 0.04 | 0.04 |
| Color mixing Inhibitor (Cpd-4) | 0 | 0 | 0 | 0 | 0.02 | 0 | 0 | 0.02 | 0 | 0.04 |

In addition, for keeping the strength of the layers of each completed color photographic paper constant, the addition amount of gelatin for each layer was changed such that the ratio of gelatin to oil-soluble components was kept constant.

First, Sample 101 was subjected to a gray exposure using an actinometer (Type FWH, color temperature of the light source 3200° K, manufactured by Fuji Photo Film Co., Ltd.) such that about 30% of the amount of coated silver would be developed.

The sample thus exposed was subjected to continuous processing by means of a color paper processor using the following processing steps and processing compositions to establish a photographic processing state corresponding to a continuous (running) equilibrium state.

| Processing Step | Temperature | Time (sec.) | Replenisher* (ml) | Tank Volume (liter) |
|---|---|---|---|---|
| Color Development | 35° C. | 45 | 161 | 17 |
| Blix | 30 to 35° C. | 45 | 215 | 17 |
| Rinse | 30° C. | 90 | 350 | 10 |
| Drying | 70 to 80° C. | 60 | | |

*Replenishing amount was per square meter of the color photographic paper.

The composition of each processing solution was as follows.

| Color Developer | Tank Liquid | Replenisher |
|---|---|---|
| Water | 800 ml | 800 ml |
| Ethylenediamine-N,N,N',N'-tetramethylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-Bis(carboxymethyl)-hydrazine | 4.0 g | 5.0 g |
| N,N-Di(sulfoethyl)hydroxylamine 1Na | 4.0 g | 5.0 g |
| Optical Whitening Agent (Whitex 4B, trade name, made by Sumitomo Chemical Company, Ltd.) | 1.0 g | 2.0 g |
| Water to make | 1000 ml | 1000 ml |
| pH (25° C.) | 10.05 | 10.45 |

| Blix Solution (Tank liquid = Replenisher) | |
|---|---|
| Water | 400 ml |
| Ammonium Thiosulfate (700 g/liter) | 100 ml |
| Sodium Sulfite | 17 g |
| Ethylenediaminetetraacetic Acid Iron(III) Ammonium | 55 g |
| Ethylenediaminetetraacetic Acid Di-sodium | 5 g |
| Ammonium Bromide | 40 g |
| Water to make | 1000 ml |
| pH (25° C.) | 6.0 |

Rinse Solution (Tank liquid = Replenisher)

Ion-exchanged water (concentration of magnesium ions and calcium ions each was below 3 ppm).

Then, each of Samples 101 to 105 was subjected to a gradation exposure to become almost gray at a color density of 1.0 through an optical wedge using an actinometer (Type TWH, manufactured by Fuji Photo Film Co., Ltd.), and then subjected to color photographic processing in the foregoing processing steps.

In the foregoing color photographic processing, three different processing runs were made, each having a different processing time. Thus, the time for the rinse step in one run was 90 seconds, in a second run was 150 seconds, and in a third run was 210 seconds, whereby the total time from the color development to the finish of the rinse step was 3 minutes, 4 minutes, or 5 minutes, respectively.

After previously measuring the optical density of each sample thus processed, for evaluating the light fastness of each sample, the sample was irradiated by light using a xenon fade-o-meter (about 300,000 luxes) for one day or using a fluorescent lamp fade-o-meter (about 10,000 luxes) for 20 days, and thereafter the optical density of each sample was measured again. The reduction ratio of the cyan density at the initial density of 2.5 on each sample is shown in Table 3 below.

Also, in order to determine the change of color at the background portions with the passage of time after processing, each sample processed was allowed to stand for 7 days under the condition of 80° C., 70% RH and the coloring extent of the background portion was determined. The coloring extent is shown in Table 3 as the change of the yellow density at the background portion.

TABLE 3

| | Sample No. | | | | | | | | | |
|---|---|---|---|---|---|---|---|---|---|---|
| | 101 | 102 | 103 | 104 | 105 | 106 | 107 | 108 | 109 | 110 |
| Xenon Fading (%) | | | | | | | | | | |
| Rinse Time 90 sec. | 4.0 | 4.0 | 4.2 | 3.8 | 8.8 | 4.4 | 4.0 | 8.9 | 4.0 | 11.0 |
| Fluorescent Lamp Fading | | | | | | | | | | |
| Rinse Time 90 sec. | 5.3 | 5.3 | 5.9 | 4.9 | 5.3 | 6.1 | 9.0 | 9.1 | 5.3 | 5.3 |
| Yellow-Staining (80° C., 70% RH) | | | | | | | | | | |
| Rinse Time 90 sec. | 0.10 | 0.10 | 0.10 | 0.11 | 0.10 | 0.13 | 0.20 | 0.21 | 0.34 | 0.38 |
| Rinse Time 150 sec. | 0.10 | 0.10 | 0.10 | 0.10 | 0.10 | 0.10 | 0.11 | 0.13 | 0.17 | 0.20 |
| Rinse Time 210 sec. | 0.10 | 0.10 | 0.10 | 0.10 | 0.10 | 0.10 | 0.10 | 0.10 | 0.13 | 0.12 |
| Remarks | Inv. | Inv. | Inv. | Inv. | Comp. | Comp. | Comp. | Comp. | Comp. | Comp. |

In Samples 106, 109, and 110, there was a relatively small lowering of the cyan density of the samples after the fluorescent lamp fading, but the color tone which preferably shall essentially be gray was strongly magenta-colored, which is undesirable. In Samples 107 to 110, the back ground portions were strongly yellow-stained by fading at 80° C. and 70% RH in the case of short-time processing of within 4 minutes, which is also undesirable. Also, in Samples 105, 108, and 110 each containing color mixing inhibitors in Layer 6, fading by xenon lamp irradiation was undesirably large.

As is clear from the results shown in Table 3 above, in the samples of the present invention, the change of the color at the background portions with the passage of time after processing is less and the tendency is remarkable when the whole processing time is 4 minutes or less. Also, it can be seen that the samples of the present invention have a strong resistance to light fading of the cyan images in both cases of irradiating intense light (xenon lamp) and weak lamp (fluorescent lamp).

In addition, when I-20 or I-23 illustrated above as the compound shown by formula (I) was used in place of Cpd-4, almost the same results were obtained.

EXAMPLE 2

The same procedure for preparing Samples 101 and 105 were followed, except that each of the cyan couplers shown in Table 4 was used in place of the cyan coupler in the above samples, to thereby prepared Samples 101A, 101B, 101C, 105A, 105B, and 105C.

TABLE 4

| | Cyan Coupler | | |
|---|---|---|---|
| Sample No. | C-6 | ExC2 | ExC3 |
| 101 | 101A | 101B | 101C |
| 105 | 105A | 105B | 105C |

The comparison cyan compounds shown in the above table are shown below:

ExC2 (for comparison)

-continued

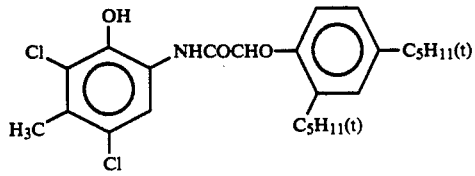

ExC3 (for comparison)

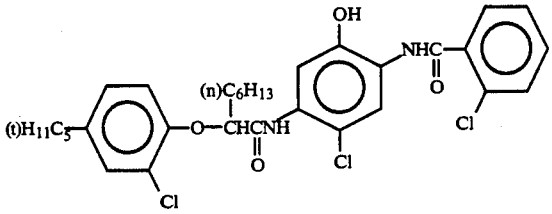

Each sample was gradation-exposed to form gray as in Example 1, and processed as in Example 1 to provide a gray-colored sample.

The samples thus processed were subjected to the light fading tests in the same manner as in Example 1.

The results obtained are shown in Table 5.

TABLE 5

| | Sample No. | | | | | | | |
|---|---|---|---|---|---|---|---|---|
| | 101 | 101A | 101B | 101C | 105 | 105A | 105B | 105C |
| Xenon Fading (%) | | | | | | | | |
| Rinse Time 90 sec. | 4.0 | 4.0 | 8.1 | 4.0 | 8.8 | 6.3 | 8.1 | 5.0 |
| Fluorescent Lamp Fading | | | | | | | | |
| Rinse Time 90 sec. | 5.3 | 5.6 | 5.5 | 14 | 5.3 | 6.0 | 5.3 | 15.1 |
| Remarks | Inv. | Inv. | Comp. | Comp. | Comp. | Comp. | Comp. | Comp. |

From the results shown in Table 5, the following can be seen. That is, samples 105, 105A, 105B, and 105C each containing color mixing inhibitors in Layer 6 show undesirably large xenon light fading, Samples 101C and 105C show undesirably large fluorescent lamp fading, and Sample 101B shows undesirably large xenon light fading. On the other hand, it can be seen that Samples 101 and 101A of the present invention each using the cyan coupler for use in the present invention, the color mixing inhibitors and the ultraviolet absorbents give preferred results for both fading tests.

EXAMPLE 3

A multilayer color photographic paper (Sample 301) having the multilayer structure shown below was prepared by applying a corona discharging treatment to the surfaces of a paper support having a polyethylene coated layer on both surfaces, forming thereon a gelatin subbing layer containing sodium benzenesulfonate, and further coating thereon the following photographic layers. Coating compositions are prepared as follows.

Preparation of Coating Compositions

In 180.0 ml of ethyl acetate, 25 g of solvent (Solv-1) and 25 g of (Solv-2) were dissolved 153.0 g of yellow coupler (ExY), 15.0 g of color image stabilizer (Cpd-1), 7.5 g of color image stabilizer (Cpd-2), and 16.0 g of color image stabilizer (Cpd-3), and the solution thus obtained was dispersed by emulsification in 1000 g of an aqueous 10% gelatin solution containing 60 ml of an aqueous solution of 10% sodium dodecylbenzenesulfonate and 10 g of citric acid to provide emulsified dispersion A.

On the other hand, silver chloride emulsion B (an emulsion containing cubic silver chlorobromide grains having an average grain size of 0.70 μm, a variation coefficient of the grain size distribution 0.10, and silver chlorobromide grains locally having 0.3 mol% silver bromide at a part of the grain surface) was prepared.

The foregoing emulsified dispersion A was mixed with silver chlorobromide emulsion B3, and the mixture was adjusted to become the composition shown below to provide a coating composition for Layer 1.

The coating compositions for Layer 2 to Layer 7 were prepared in a similar manner to that used for preparing the coating composition for Layer 1.

Each layer contained 1-oxy-3,5-dichloro-s-triazine sodium salt as a gelatin salt.

Also, to each layer were added Cpd-15 and Cpd-16 so that the total amounts of these compounds in the light-sensitive material were 25.0 g/M$^2$ and 50.0 mg/M$^2$ of light-sensitive material, respectively.

Preparation of Emulsion G1

To an aqueous solution of 3% limed gelatin was added 3.3 g of sodium chloride, and then 3.2 ml of N,N-dimethylimidazolidine-2-thione (aqueous 1% solution) was added to the mixture. To the solution thus formed were added an aqueous solution of 0.5 mol of silver nitrate and an aqueous solution of 0.5 mol of sodium chloride at 69° C. with stirring vigorously. Thereafter, an aqueous solution of 0.45 mol of silver nitrate and an aqueous solution of 0.45 mol of sodium chloride were added to the mixture at 69° C. with stirring vigorously. Then, desalting was performed at 40° C. by flocculation and washing with the addition of a copolymer of isobutene and maleic acid mono-sodium salt. Furthermore, 90.0 g of limed gelatin was added to the emulsion and then the pH and pAg of the emulsion were adjusted to 6.2 and 6.5, respectively. To the emulsion was added a silver bromide fine grain emulsion having an average grain size of 0.05 μm in an amount of 0.008 mol as a silver amount at 50° C. and further, the silver halide emulsion was most suitably sulfur-sensitized with triethylthiourea. In addition, the silver bromide fine grains contained potassium hexachloroiridate(VI) in an amount of 3.54 mg per 0.022 mol of silver which was added during the formation of the silver bromide grains. The silver halide emulsion composed of high-silver chloride grains having a silver bromide-enriched phase at the surface of the grains thus obtained was defined as Emulsion G1.

Preparation of Emulsion G2

By following the same procedure as the preparation of Emulsion G1, except that after applying the sulfur sensitization, 2.3×10-6 mol of tetrachloroauric (III) acid was added thereto to most suitably gold sensitize the emulsion, Emulsion G2 was prepared.

Preparation of Emulsion G3

By following the same procedure as the preparation of Emulsion G1, except that the formation of the silver bromide-enriched phase by the addition of the silver bromide fine grains was not carried out and after sensitization, $1.6\times10^{-6}$ of tetracyanoauric(III) acid was added to the emulsion to most suitably gold sensitize the emulsion, Emulsion G3 was prepared.

From electrophotographs of the silver halide Emulsions G1 to G3 thus obtained, the forms of the silver halide grains, the grain sizes, and the grain size distributions were determined.

In the present invention, the grain size is shown by the average value of circles which are equivalent to the projected area of the grains, and the grain size distribution is shown by the value obtained by dividing the standard deviation of the grain sizes by the average grain size.

Each of the 3 silver halide Emulsions G1 to G3 contained cubic silver halide grains having an average grain size of 0.42 μm and a grain size distribution of 0.08.

For the silver chlorobromide emulsion of each light-sensitive silver halide emulsion layer were used the spectral sensitizing dyes in Example 1. An amount of the spectral sensitizing dyes used in each photo sensitive layers is the same amount added to a small grain size emulsion in the blue-sensitive layer and the same amount added to a large grain size emulsion in the green-sensitive layer and red-sensitive layer, respectively.

Also, to the blue-sensitive emulsion layer, the green-sensitive emulsion layer, and the red-sensitive emulsion layer, there was added 1-(5-methylureidophenyl)-5-mercaptotetrazole in the amounts of $3.4\times10^{-4}$ mol, $9.7\times10^{-4}$ mol. and $5.5\times10^{-4}$ mol, respectively, per mol of silver halide.

Furthermore, to the blue-sensitive emulsion layer and the green-sensitive emulsion layer, there was added 4-hydroxy-6-methyl-1,3,3a,7-tetraazaindene in the amounts of $1\times10^{-4}$ mol and $2\times10^{-4}$ mol, respectively, per mol of silver halide.

Also, for irradiation prevention, the same amount of the same dyes as used in Example 1 were added to the color mixing inhibition layers (Layers 2 and 4).

Layer Structure

Then, the composition of each layer was shown below, wherein the numeral showed the coated amount (g/m$^2$). The coated amount (g/m$^2$) of the silver halide emulsions are expressed in terms of the amount converted to silver.

Support

Polyethylene-coated paper (The polyethylene coated layer at the emulsion layer side contained a white pigment ($TiO_2$) and a bluish dye (ultramarine blue)).

| | Coated Amounts |
|---|---|
| Layer 1 (Blue-Sensitive Emulsion Layer) | |
| Silver Chlorobromide Emulsion B shown above | 0.27 |
| Gelatin | 1.09 |
| Yellow Coupler (ExY) | 0.79 |
| Color Image Stabilizer (Cpd-1) | 0.08 |

-continued

| | Coated Amounts |
|---|---|
| Color Image Stabilizer (Cpd-2) | 0.04 |
| Color Image Stabilizer (Cpd-3) | 0.08 |
| Solvent (Solv-1) | 0.08 |
| Solvent (Solv-2) | 0.18 |
| Layer 2 (Color Mixing Inhibiting Layer) | |
| Gelatin | 0.82 |
| Color Mixing Inhibitor (Cpd-4) | 0.08 |
| Solvent (Solv-2) | 0.25 |
| Solvent (Solv-3) | 0.25 |
| Layer 3 (Green-Sensitive Emulsion Layer) | |
| Silver Chlorobromide Emulsion G1 shown above | 0.11 |
| Gelatin | 1.42 |
| Magenta Coupler (ExM) | 0.15 |
| Color Image Stabilizer (Cpd-6) | 0.15 |
| Color Image Stabilizer (Cpd-2) | 0.03 |
| Color Image Stabilizer (Cpd-7) | 0.01 |
| Color Image Stabilizer (Cpd-8) | 0.01 |
| Color Image Stabilizer (Cpd 9) | 0.08 |
| Solvent (Solv-3) | 0.50 |
| Solvent (Solv-4) | 0.15 |
| Solvent (Solv-5) | 0.15 |
| Layer 4 (Color Mixing Inhibiting Layer) | |
| Gelatin | 0.70 |
| Color Mixing Inhibitor (Cpd-4) | 0.04 |
| Color Image Stabilizer (Cpd-5) | 0.02 |
| Solvent (Solv-2) | 0.18 |
| Solvent (Solv-3) | 0.18 |
| Layer 5 (Red-Sensitive Emulsion Layer) | |
| Silver Chlorobromide Emulsion (cubic, average grain size 0.58 μm, variation coeff. of grain size distribution 0.09, locally having 0.6 mol % AgBr at a part of the grain surface) | 0.20 |
| Gelatin | 0.74 |
| Cyan Coupler (ExC) | 0.33 |
| Ultraviolet Absorbent (UV-2) | 0.18 |
| Color Image Stabilizer (Cpd-1) | 0.35 |
| Color Image Stabilizer (Cpd-10) | 0.15 |
| Color Image Stabilizer (Cpd-11) | 0.15 |
| Color Image Stabilizer (Cpd-12) | 0.01 |
| Color Image Stabilizer (Cpd-9) | 0.01 |
| Color Image Stabilizer (Cpd-8) | 0.01 |
| Solvent (Solv-6) | 0.14 |
| Solvent (Solv-1) | 0.04 |
| Layer 6 (Ultraviolet Absorption Layer) | |
| Gelatin | 0.55 |
| Ultraviolet Absorbent (UV-1) | 0.40 |
| Color Image Stabilizer (Cpd-13) | 0.15 |
| Color Image Stabilizer (Cpd-6) | 0.02 |
| Layer 7 (Protective Layer) | |
| Gelatin | 1.13 |
| Acryl-Modified Copolymer (modification degree 17%) of Polyvinyl Alcohol | 0.15 |
| Liquid Paraffin | 0.03 |

-continued

| | Coated Amounts |
|---|---|
| Color Image Stabilizer (Cpd-14) | 0.01 |

The compounds used for preparing the color photographic paper are shown in Example 1.

Furthermore, the same procedure used to prepare Sample 301 was followed, except that the compositions of Layer 3, Layer 4, and Layer 5 were changed as shown in Table 6 shown below, to thereby prepare Samples 302 to 314.

In addition, for keeping the strength of the layers of the color photographic paper constant, the addition amount of gelatin in each layer was changed such that the ratio of gelatin with oil-soluble components was kept constant.

TABLE 6

| | Sample No. | | | | | | | | | | | | | |
|---|---|---|---|---|---|---|---|---|---|---|---|---|---|---|
| | 301 | 302 | 303 | 304 | 305 | 306 | 307 | 308 | 309 | 310 | 311 | 312 | 313 | 314 |
| Third Layer | | | | | | | | | | | | | | |
| Green-sensitive Emulsion | G1 | G1 | G1 | G1 | G1 | G1 | G1 | G1 | G1 | G1 | G2 | G2 | G3 | G3 |
| Fourth Layer | | | | | | | | | | | | | | |
| Gelatin | 0.70 | 0.70 | 0.70 | 0.70 | 0.70 | 0.95 | 1.30 | 1.30 | 1.30 | 1.30 | 0.70 | 0.70 | 0.70 | 0.70 |
| Color mixing Inhibitor (Cpd-4) | 0.04 | 0.04 | 0.04 | 0.04 | 0.04 | 0.04 | 0.04 | 0.04 | 0.04 | 0.04 | 0.04 | 0.04 | 0.04 | 0.0 |
| Color Image stabilizer (Cpd-5) | 0.02 | 0.02 | 0.02 | 0.02 | 0.02 | 0.02 | 0.02 | 0.02 | 0.02 | 0.02 | 0.02 | 0.02 | 0.02 | 0.02 |
| Solvent (Solv-2) | 0.18 | 0.18 | 0.18 | 0.18 | 0.18 | 0.18 | 0.18 | 0.18 | 0.18 | 0.18 | 0.18 | 0.18 | 0.18 | 0.18 |
| Solvent (Solv-3) | 0.18 | 0.18 | 0.18 | 0.18 | 0.18 | 0.18 | 0.18 | 0.18 | 0.18 | 0.18 | 0.18 | 0.18 | 0.18 | 0.18 |
| Ultraviolet Abosrbent (UV-1) | 0 | 0 | 0 | 0 | 0 | 0.15 | 0.20 | 0.20 | 0.20 | 0.20 | 0 | 0 | 0 | 0 |
| Sixth Layer | | | | | | | | | | | | | | |
| Gelatin | 0.55 | 0.50 | 0.41 | 0.61 | 0.57 | 0.41 | 0.35 | 0.37 | 1.10 | 1.10 | 0.55 | 0.50 | 0.55 | 0.50 |
| Ultraviolet Absorbent (UV-1) | 0.40 | 0.36 | 0.30 | 0.44 | 0.40 | 0.25 | 0.20 | 0.20 | 0.40 | 0.40 | 0.40 | 0.36 | 0.40 | 0.36 |
| Color Image stabilizer (Cpd-5) | 0.15 | 0.14 | 0.11 | 0.17 | 0.15 | 0.15 | 0.15 | 0.15 | 0.30 | 0.30 | 0.15 | 0.14 | 0.15 | 0.14 |
| Color Image stabilizer (Cpd-5) | 0.02 | 0.02 | 0.02 | 0.02 | 0.02 | 0.02 | 0.02 | 0.02 | 0.04 | 0.04 | 0.02 | 0.02 | 0.02 | 0.02 |
| Color mixing Inhibitor (Cpd-4) | 0 | 0 | 0 | 0 | 0.02 | 0 | 0 | 0.02 | 0 | 0.04 | 0 | 0 | 0 | 0 |

First, a gray exposure was applied to Sample 301 using an actinometer (Type RWH, the color temperature of the light source 3200° K, manufactured by Fuji Photo Film Co., Ltd.) such that about 30% of the coated silver would be developed.

The sample thus exposed was subjected to continuous processing by means of a paper processor using the same processing steps and the same processing compositions as in Example 1 to establish a photographic processing state corresponding to a continuous (running) equilibrium state.

Then, each of Samples 301 to 314 was subjected to a gradation-exposure to become almost gray at a color density of 1.0 using an actinometer (Type FWH, manufactured by Fuji Photo Film Co., Ltd.) through an optical wedge and subjected to color photographic processing by the foregoing processing steps.

In the color photographic processing, three different processing runs was made, each having a different processing time. Thus, the time for the rinse step in one run was 90 seconds, in a second run was 150 seconds, and in a third run was 210 seconds whereby the total time from the color development to the rinse step was 3 minutes, 4 minutes, or 5 minutes, respectively.

After previously measuring the optical density of each sample thus processed, for evaluating the light fastness of the sample, after irradiating each sample with a xenon fading tester (about 300, luxes) for one day or with a fluorescent lamp fading tester (about 10,000 luxes) for 20 days, the optical density of each sample was measured again. The reduction ratio of the cyan density of each sample at the initial density of 2.5 is shown in Table 7 below.

Also, in order to determine the change of color at the background portions with the passage of time after processing, each sample thus processed was allowed to stand for 7 days under the conditions of 80° C., 70% RH and then the coloring extent of the background portion was determined. The coloring extent is shown in Table 7 by the change of the yellow density at the background portion.

Furthermore, the gradation of the high density portion of magenta was obtained by the difference of the logarithms of the exposure amounts giving the densities 2.0 and 2.5 of each sample before applying the fading test.

TABLE 7

| | Sample No. | | | | | | | | | | | | | |
|---|---|---|---|---|---|---|---|---|---|---|---|---|---|---|
| | 301 | 302 | 303 | 304 | 305 | 306 | 307 | 308 | 309 | 310 | 311 | 312 | 313 | 314 |
| Xenon Fading (%) | | | | | | | | | | | | | | |
| Rinse Time 90 sec. | 4.0 | 4.0 | 4.2 | 3.8 | 8.8 | 4.4 | 4.0 | 8.9 | 4.0 | 11.0 | 4.0 | 4.0 | 4.0 | 4.0 |
| Fluorescent Lamp Fading (%) | | | | | | | | | | | | | | |
| Rinse Time 90 sec. | 5.3 | 5.3 | 5.9 | 4.9 | 5.3 | 6.1 | 9.0 | 9.1 | 5.3 | 5.3 | 5.3 | 5.3 | 5.3 | 5.3 |
| Yellow-Staining (80° C. 70% RH) | | | | | | | | | | | | | | |
| Rinse Time 90 sec. | 0.10 | 0.10 | 0.10 | 0.11 | 0.10 | 0.13 | 0.20 | 0.21 | 0.34 | 0.38 | 0.10 | 0.10 | 0.10 | 0.10 |
| Rinse Time 150 sec. | 0.10 | 0.10 | 0.10 | 0.10 | 0.10 | 0.10 | 0.11 | 0.13 | 0.17 | 0.20 | 0.10 | 0.10 | 0.10 | 0.10 |
| Rinse Time 210 sec. | 0.10 | 0.10 | 0.10 | 0.10 | 0.10 | 0.10 | 0.10 | 0.10 | 0.13 | 0.12 | 0.10 | 0.10 | 0.10 | 0.10 |
| Magenta Gradation | | | | | | | | | | | | | | |
| Rinse Time 90 sec. | 0.42 | 0.40 | 0.38 | 0.46 | 0.42 | 0.37 | 0.36 | 0.36 | 0.36 | 0.36 | 0.22 | 0.22 | 0.22 | 0.22 |

In Samples 306, 309, and 310, there was a relatively small lowering of the cyan density of each sample after fluorescent lamp fading, but the color tone which preferably shall essentially be gray was strongly colored in magenta, which is undesirable. In Samples 307 and 310, yellow stains undesirably formed on the background portions at fading under the condition of 80° C., 70% RH in short-time processing within 4 minutes. Also, in Samples 305, 308, and 310, each of which contained the color mixing inhibitors in Layer 6, fading by the xenon fading test was undesirably large.

As is clear from the results shown in Table 7, Samples 301, 304, 311, and 314 had less of a change in color in the background portions with the passage of time after processing, and the tendency is remarkable when the total processing time is 4 minutes or less. Also, it can be seen that the samples of the present invention show a strong light fading resistance of cyan images in both intense light (xenon lamp) and weak light (fluorescent lamp). However, Samples 301 and 304 which did not contain a gold-sensitized silver halide emulsion are undesirable since the high density portion of magenta was soft and the portions essentially showing from dark gray to black became greenish and thereby lost a firm black tone. It can be also seen that in Samples 311 and 314 of the present invention, images having a hard magenta gradation and a firm black tone can be first obtained.

Also, when I-20 or I-2 was used in place of Cpd-4, almost the same effect was obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a reflecting support and provided thereon three light-sensitive silver halide emulsion layers each having a light sensitivity to a different wavelength region, including a light sensitive silver halide emulsion layer containing a yellow dye-forming coupler, a light sensitive silver halide emulsion layer containing a magenta dye-forming coupler, and a light sensitive silver halide emulsion layer containing a cyan dye-forming coupler, wherein (1) said cyan coupler is a compound represented by the following formula (C), and of the three silver halide emulsion layers, the silver halide emulsion layer containing the cyan coupler is disposed at the farthest position from the support, (2) a hydrophilic light-insensitive layer which contains compound represented by the following formula (I) and which does not contain an ultraviolet absorber or does contain an ultraviolet absorber in an amount of less than 100 mg/m$^2$ of light sensitive material, is adjacent to said cyan coupler-containing silver halide emulsion layer and closer to the support than the cyan coupler-containing layer, (3) a hydrophilic light-insensitive layer which contains an ultraviolet absorbent and which does not contain or does contain, in an amount of less than 10 mg/m$^2$, a compound represented by the following formula (I), is further away from the support than said cyan coupler-containing silver halide emulsion layer, and (4) the average silver chloride content of the silver halide contained in each silver halide emulsion layer is at least 90 mol%;

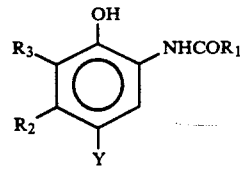

(C)

wherein $R_1$ represents a substituted or unsubstituted aliphatic group, a substituted or unsubstituted aromatic group, or a substituted or unsubstituted heterocyclic group; $R_2$ represents a substituted or unsubstituted aliphatic group having at least 2 carbon atoms; $R_3$ represents a hydrogen atom, a halogen atom, a substituted or unsubstituted aliphatic group, a substituted or unsubstituted aromatic group, or an acylamino group; and Y represents a hydrogen atom or a group capable of splitting off upon a coupling reaction with an oxidation product of a developing agent;

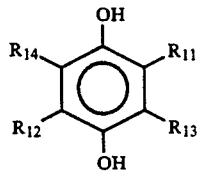

(I)

wherein $R^{11}$ represents a hydrogen atom or a substituent; $R_{12}$, which may be same as or different from $R_{11}$, represents a hydrogen atom or a substituent; and $R_{13}$ and $R_{14}$, which may be the same or different, each represents a hydrogen atom or a substituent, and at least one of said $R_{11}$ to $R_{14}$ must be a substituent.

2. The silver halide color photographic material of claim 1, wherein the silver halide emulsion of the photographic material is silver chlorobromoiodide, silver chlorobromide, silver chloroiodide, or silver chloride.

3. The silver halide color photographic material of claim 1, wherein the silver halide present in at least one of the silver halide emulsion layers is gold-sensitized using a gold compound.

4. A color photographic image forming process comprising:

(a) subjecting to color photographic processing a silver halide color photographic material, said color photographic processing comprising color development of an image-wise exposed silver halide color photographic material, and washing or stabilizing the photographic material after said color development, wherein the silver halide color photographic material which is subjected to the color photographic processing comprises a reflecting support having provided thereon three light-sensitive silver halide emulsion layers each having a light sensitivity to a different wavelength region, including a light sensitive silver halide emulsion layer containing a yellow dye-forming coupler, a light sensitive silver halide emulsion layer containing a magenta dye-forming coupler, and a light sensitive silver halide emulsion layer containing a cyan dye-forming coupler, wherein (1) said cyan coupler is a compound represented by the following formula (C), and of the three silver halide emulsion layers, the silver halide emulsion layer containing the cyan coupler is disposed at the farthest position from the support (2) a hydrophilic light-insensitive layer which contains a compound represented by the following formula (I) and which does not contain an ultraviolet absorber or does contain an ultraviolet absorber in an amount of less than 100 mg/m$^2$ of light sensitive material, is adjacent to said cyan coupler-containing silver halide emulsion layer and closer to the support than the cyan coupler-containing layer (3) a hydrophilic light-insensitive layer which contains an ultraviolet absorbent and which does not contain or does contain, in an amount of less than 10 mg/m$^2$, a compound represented by the following formula (I), is further away from the support than said cyan coupler-containing silver halide emulsion layer, and (4) the average silver chloride content of the silver halide contained in each silver halide emulsion layer is at least 90%; and (b) providing a total time from a starting of the color development to an end of the wash step and/or the stabilization step through the desilvering step in the color photographic processing of 4 minutes or less;

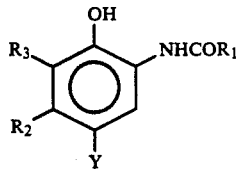

(C)

wherein $R_1$ represents a substituted or unsubstituted aliphatic group, a substituted or unsubstituted aromatic group, or a substituted or unsubstituted heterocyclic group; $R_1$ represents a substituted or unsubstituted aliphatic group having at least 2 carbon atoms; $R_3$ represents a hydrogen atom, a halogen atom, a substituted or unsubstituted aliphatic group, or a substituted or unsubstituted aromatic group, and Y represents a hydrogen atom or a group which is capable of splitting off upon a coupling reaction with an oxidation product of a developing agent;

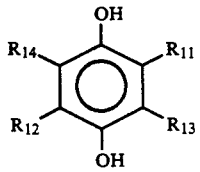

(I)

wherein $R^{11}$ represents a hydrogen atom or a substituent; $R_{12}$, which may be same as or different from $R_{11}$, represents a hydrogen atom or a substituent; and $R_{13}$ and $R_{14}$, which may be the same or different, each represents a hydrogen atom or a substituent, and at least one of said $R_{11}$ to $R_{14}$ must be a substituent.

5. The color photographic image forming process of claim 4, wherein at least one layer of the silver halide emulsion layers is gold-sensitized with a gold compound.

6. A silver halide color photographic material according to claim 1, wherein the substituent represented by $R_{11}$ and $R_{12}$ are independently selected from the group consisting of an alkyl group, an alkenyl group, an aryl group, an acyl group, a cycloalkyl, a sulfonic acid group, a halogen atom, and a heterocyclic group, the substituents represented by $R_{13}$ and $R_{14}$ are independently selected from the group consisting of a halogen atom, an alkyl group, an aryl group, a cycloalkyl group, an alkoxy group, an aryloxy group, an arylthio group, an acyl group, an alkylacetylamino group, an alkylcarbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, an alkylsulfonyl group, an arylsulfonyl group, a nitro group, a cyano group, an alkyloxycarbonyl group, an aryloxycarbonyl group, an alkylacyloxy group, and an aryloxy group.

7. The silver halide color photographic material according to claim 1, wherein $R_1$ represents a substituted or unsubstituted alkyl group of a substituted or unsubstituted aryl group, $R_2$ represents an alkyl group having from 2 to 15 carbon atoms or a methyl group having a substituent containing 1 or more carbon atoms $R_3$ represents a hydrogen atom or a halogen atom, and Y represents a hydrogen atom, a halogen atom, an alkoxy group, an aryloxy group, an acyloxy group, or a sulfonamido group.

* * * * *